US011064798B2

(12) United States Patent
Sanchez

(10) Patent No.: US 11,064,798 B2
(45) Date of Patent: Jul. 20, 2021

(54) APPLICATOR MEMBER COMPRISING TWO ASSEMBLED PARTS

(71) Applicant: L'OREAL, Paris (FR)

(72) Inventor: Marcel Sanchez, Aulnay sous Bois (FR)

(73) Assignee: L'OREAL, Paris (FR)

( * ) Notice: Subject to any disclaimer, the term of this patent is extended or adjusted under 35 U.S.C. 154(b) by 738 days.

(21) Appl. No.: 15/514,801

(22) PCT Filed: Sep. 25, 2015

(86) PCT No.: PCT/EP2015/072069
§ 371 (c)(1),
(2) Date: Mar. 27, 2017

(87) PCT Pub. No.: WO2016/046355
PCT Pub. Date: Mar. 31, 2016

(65) Prior Publication Data

US 2017/0290411 A1 Oct. 12, 2017

(30) Foreign Application Priority Data

Sep. 25, 2014 (FR) ..... 1459076

(51) Int. Cl.
*A46B 5/00* (2006.01)
*A46B 9/02* (2006.01)
(Continued)

(52) U.S. Cl.
CPC ..... *A46B 5/0012* (2013.01); *A45D 33/00* (2013.01); *A45D 34/045* (2013.01);
(Continued)

(58) Field of Classification Search
CPC .... A46D 3/005; A46B 5/0012; A46B 5/0008; A46B 5/0016; A46B 5/0037; A46B 9/005;
(Continued)

(56) References Cited

U.S. PATENT DOCUMENTS 2,004,044 A * 6/1935 Fiegel ..... A46B 9/00 132/120
4,458,701 A * 7/1984 Holland ..... A45D 40/265 132/218
(Continued)

FOREIGN PATENT DOCUMENTS

EP 0 792 602 A1 9/1997
EP 0 839 472 A1 5/1998
(Continued)

OTHER PUBLICATIONS

Jun. 4, 2018 Office Action issued in Japanese Patent Application No. 2017-516485.
(Continued)

*Primary Examiner* — Nicholas D Lucchesi
(74) *Attorney, Agent, or Firm* — Oliff PLC

(57) ABSTRACT

An applicator member for applying a cosmetic product to human keratin materials, including an applicator head having two opposite faces, the applicator head including: a first part having at least one housing, and a second part that is connected to the first part by a hinge and is at least partially engaged in the housing of the first part, wherein the first and second parts are both accessible from each of the faces of the applicator head.

33 Claims, 18 Drawing Sheets

Figure 1:
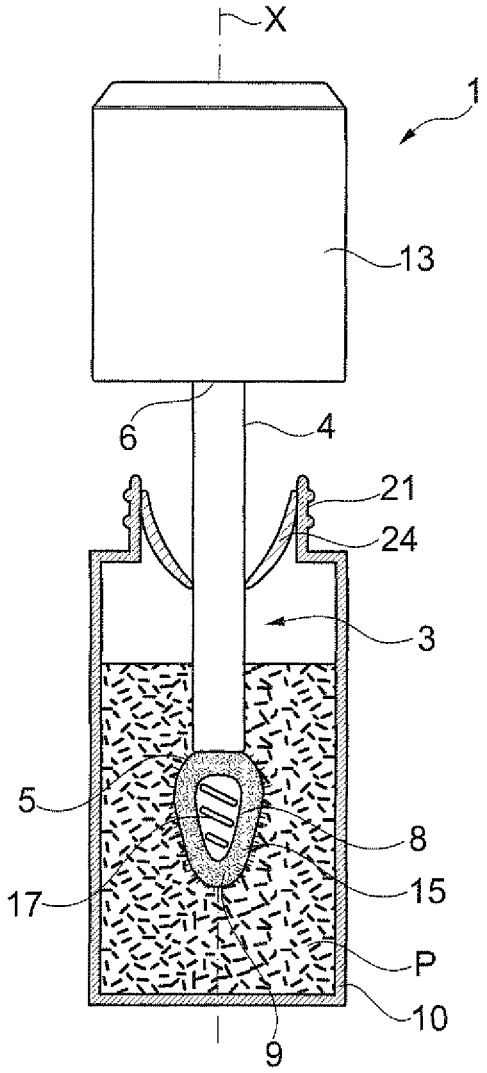

(51) Int. Cl.

| | |
|---|---|
| ***A46B 9/00*** | (2006.01) |
| ***A45D 34/04*** | (2006.01) |
| ***A45D 40/26*** | (2006.01) |
| ***A45D 33/00*** | (2006.01) |
| ***A46D 3/00*** | (2006.01) |

(52) U.S. Cl.
CPC ..... *A45D 34/046* (2013.01); *A45D 40/265* (2013.01); *A45D 40/267* (2013.01); *A46B 5/0008* (2013.01); *A46B 5/0016* (2013.01); *A46B 5/0037* (2013.01); *A46B 9/005* (2013.01); *A46B 9/021* (2013.01); *A46D 3/005* (2013.01); *A46B 2200/1046* (2013.01); *A46B 2200/1053* (2013.01)

(58) Field of Classification Search
CPC ..... A46B 9/021; A46B 2200/1046; A46B 2200/1053; A45D 33/00; A45D 34/045; A45D 34/046; A45D 40/265; A45D 40/267
See application file for complete search history.

(56) References Cited

U.S. PATENT DOCUMENTS

| | | | | |
|---|---|---|---|---|
| 5,007,442 | A | 4/1991 | Hirzel | |
| D474,343 | S * | 5/2003 | Cammarano | D4/120 |
| 7,748,391 | B2 * | 7/2010 | Vance | A45D 24/04 132/126 |
| 8,851,775 | B2 * | 10/2014 | Jacob | A45D 40/267 401/129 |
| 8,894,309 | B2 * | 11/2014 | Geuther | A45D 40/26 132/218 |
| 2007/0020027 | A1 | 1/2007 | Gueret | |
| 2011/0282243 | A1 | 11/2011 | Nakatani | |

FOREIGN PATENT DOCUMENTS

| | | | |
|---|---|---|---|
| EP | 1 070 467 | A2 | 1/2001 |
| EP | 1 726 235 | A2 | 11/2006 |
| FR | 2 995 017 | A1 | 3/2014 |
| JP | 2001-145515 | A | 5/2001 |
| JP | 2008-114057 | A | 5/2008 |
| JP | 2011-234666 | A | 11/2011 |
| JP | 2012-055375 | A | 3/2012 |
| JP | 2013-056213 | A | 3/2013 |
| JP | 2014-087642 | A | 5/2014 |
| WO | 2008/140152 | A1 | 11/2008 |
| WO | 2014/147331 | A1 | 9/2014 |

OTHER PUBLICATIONS

Dec. 7, 2015 International Search Report issued in International Patent Application No. PCT/EP2015/072069.

* cited by examiner

APPLICATOR MEMBER COMPRISING TWO ASSEMBLED PARTS

The present invention relates to the application of a cosmetic product to human keratin materials, in particular the skin, the lips, or the eyelashes and/or eyebrows.

European Patent Application EP 2 976 162 discloses a device for treating human keratin materials, in particular the skin, comprising two parts that are fixed together in a removable manner and define two opposite faces of the applicator, making it possible to carry out different treatments. The first face makes it possible for example to apply a cosmetic product and the second face makes it possible to remove, clean off or absorb impurities.

European Patent Applications EP 1 726 235 and EP 0 792 602 disclose cosmetic product applicators that comprise a cavity for holding the product to be applied.

A flocked applicator comprising a housing that holds a foam impregnated with a cosmetic product is known from European Patent Application EP 0 839 472.

European Patent Application EP 1 070 467 discloses an applicator comprising a first part and a second part joined by a hinge and forming a line of teeth disposed alternatively on different side of a separation face.

U.S. Pat. No. 5,007,442 discloses a tong shape apparatus comprising an applicator brush and a comb applicator at the ends of two rods connected by a pivot with a spring action, the spring action forcing the rods to open in absence of external forces.

WO 2008/140152 discloses a curling mascara apparatus comprising an upper tong hinged at an end thereof to a lower tong so as to perform a clamping operation for curling the eyelashes.

French Patent Application FR 2 995 017 discloses an applicator comprising a succession of bristles on a first portion and additional application elements distinct from the bristles on a second portion that may be hinged to the first portion.

There is a need to further improve packaging and application devices and in particular to benefit from a device which is easy to produce and which makes it possible to obtain new treatment or makeup effects.

A subject of the invention, according to one of its aspects, is thus an applicator member for applying a cosmetic product to human keratin materials, comprising an applicator head having two opposite faces, the applicator head comprising:

- a first part having at least one housing, and
- a second part that is connected to the first part by a hinge and is at least partially and fixedly engaged in the housing of the first part, wherein the first and second parts are both accessible from each of said faces of the applicator head.

By "fixedly engaged", it should be understood that in an applicator according to the present invention, the second part of the applicator head remains engaged in the housing of the first part and is not easily movable relative to the latter. No external force for example exerted by a user or by a collar of a reservoir into which the applicator head is inserted is needed for maintaining the engagement.

The applicator head can have a flattened overall shape and said faces can correspond to the main faces.

The invention affords new possibilities for producing the applicator member, with different surface states and/or different materials on the first and second parts. In particular, the invention makes it very easily possible for only one of the parts to be flocked, if so desired, or for them to be flocked differently. Such partial flocking, limited to one of the parts, also gives the applicator an attractive appearance.

The expression "are both accessible from each of said faces of the applicator head" is understood as meaning that, on each of these faces, the first and second parts are at least partially present at the surface and/or accessible through a through-opening. This can make it possible, if desired, to produce the applicator member such that, during the application of the cosmetic product from one of said faces, the human keratin materials come into contact with at least one of the first and second parts, better still into contact with both if the user so desires.

Along at least a portion of the length of the applicator member, it is possible for both portions to be visible on each of said faces; in a variant, along at least a portion of the length of the applicator member, only one of the parts is visible on one of said faces. This is the case, for example, when the first part has a housing in the form of a slot in which an upper portion of the second part bearing spikes is engaged, the second part comprising a lower part that defines a shoulder at the base of the upper portion, and when the first part is set back from the edge of this shoulder.

The body of the applicator member can be produced in one piece, by molding the neoplastic material(s).

Preferably, the housing in the first part is a through-housing, thereby allowing access to the second part from each of said faces of the applicator head.

The second part can contain the product to be applied. It can thus comprise, on at least one of said faces, a cavity containing the cosmetic product to be applied. Preferably, the cavity is different from spaces folded between adjacent bristles or teeth present on an applicator. This product is for example semi-solid, of the rouge or lip-gloss, foundation, mascara or eyeshadow type, and comes directly into contact with the keratin materials during the use of the applicator member.

The product contained in the cavity can be in the faun of a poured or compacted mass of product, without impregnation of a porous structure. In a variant, the mass of product impregnates a porous structure.

Thus, in a variant, the second part comprises, on at least one of said faces, a porous material which can be impregnated with the cosmetic product prior to being used for the first time, or in a variant, be impregnated with product during first use.

The possibility of producing the applicator member, if desired, with product contained therein without the latter having to be taken up makes it possible to reduce the bulkiness of the device and to make it easier to use.

In a variant, the user makes use of a reservoir of product and the applicator member belongs, for example, to an applicator designed to close this container when not in use.

Preferably, the above mentioned hinge is disposed on the applicator member away from the distal end of the applicator head. The hinge is preferably a film hinge or comprises two flexible strands. The hinge can be molded with the body of the applicator member from a thermoplastic material.

At least one of the first and the second part, preferably the first part, is at least partially, better still entirely, flocked. The flocking bristles allow better retention of the cosmetic product on the applicator member and make it easier to spread it over the area to be treated. Preferably, the other of the first and the second part, in particular the second part, is not flocked. This makes it possible, if desired, to limit the quantity of cosmetic product that collects on the applicator member.

This other part can be produced without a cavity forming a reservoir.

One or more reliefs can be produced on this other part in order to exert for example a massaging action on the skin or the lips or to separate the eyelashes or eyebrows.

In a variant, this other part is at least partially flocked, but the flocking of the first part can be different from the flocking of the second part, in particular in teens of quantity of fibers, sizes of fibers and/or physical properties of the fibers, for example stiffness of the fibers. Two different flockings can make it possible to have different effects during the application of the cosmetic product. In addition, attractive aesthetic effects can be obtained, by using for example different colours for the fibres.

At least one of the first and second parts, preferably the second part, can have protruding or recessed reliefs, for example in the form of spikes, bosses, ridges, grooves, or cavities, in particular in a regular arrangement. Advantageously, the first part is flocked and the second part comprises recessed or protruding reliefs, for example in the form of spikes. The presence of spikes can make it possible to separate the eyelashes and/or eyebrows during the application of product to the latter.

The first part can bear a flocked coating and the second part spikes, or vice versa, in particular one or more rows of longitudinally extending spikes.

The protruding reliefs can also be produced so as to make it possible to bring out a massaging effect on the skin or this lips during the application of the cosmetic product. The recessed reliefs can promote the accumulation of product on the applicator member and enhance the autonomy thereof.

The second part can protrude upwardly and/or downwardly from the first part when the applicator member is viewed from the side in the horizontal state. It can be smooth and have an overall shape that protrudes upwardly and downwardly from the first part, being for example in the form of a ball having a diameter greater than the thickness of the first part. The expression "side view" denotes a view perpendicularly to a median plane for said faces, this median plane being substantially perpendicular to the flattening plane of the applicator head.

The second part may bear a pattern or an inscription in the form of a relief or printing.

The second part may take up all of the housing of the first part. In a variant, the second part only takes up some of the housing of the first part, the first and the second part defining a space between one another for product to collect in. This space is filled for example with product when the applicator member is dipped into a container containing the product.

The second part may be engaged entirely in the corresponding housing of the first part.

The first part may be produced with two arms that meet at their ends and define between one another the housing in which the second part is engaged.

When one of said faces is viewed from the front, the first part can extend all around the second part. The first part can bear a flocked coating all around the second part.

The applicator head can have a width which decreases, in front view, in the direction of its free end.

The two arms of the second part can converge towards one another in the direction of the distal free edge.

The applicator head can have, in side view, a thickness which varies relatively little in the direction of the distal free edge, in particular which varies by less than 25% from a thickness at a given location, along 90% of its length.

The contour of the second part may be rounded both in cross section and when it is viewed from the front.

The second part may be engaged partially in the housing of the first part and not entirely; for example a fixing tab of the second part is engaged in the housing of the first part. The first part then surrounds the second part at least partially, better still entirely.

The second part can comprise a through-opening through which the first part is accessible. When one of said faces is viewed from the front, the visible surface of the second part can surround the visible surface of the first part at least partially, better still entirely. When the other of said faces is viewed from the front, the visible surface of the first part can surround the visible surface of the second part at least partially, better still entirely.

Preferably, the first part is made of a flexible material, in particular elastomer.

The first and the second part preferably form a single part moulded in thermoplastic material.

Preferably, the applicator head is attached to a mounting or gripping end piece of the applicator member. The end piece is preferably formed from two half end pieces that are connected together by the above mentioned hinge. Preferably, this hinge is disposed at the end of the end piece away from the applicator head. The two half end pieces can be flapped together to form the complete end piece, serving for example to be mounted in an applicator stem.

The applicator member may comprise an end piece substantially in the form of a cylinder of revolution, formed by two half end pieces; each half end piece can be attached to one of said parts by a flared transition zone that widens in the direction of the corresponding part.

A portion of the applicator member can be overmoulded on the rest of the applicator, in particular in a different material.

The applicator head can extend with its longitudinal axis aligned with that of the end piece. In a variant, the longitudinal axis of the applicator head forms a non-zero angle with that of the end piece.

The first and the second part can be fixed together in the use configuration, so as to be easily disassemblable or not, by snap-fastening or force-fitting. The second part may comprise a protruding relief at its periphery, said protruding relief cooperating with a recessed relief on the first part, or vice versa. In a variant, the two half end pieces or the first and second parts comprise other cooperating reliefs that make it possible to keep the first and second parts in the use configuration.

The first part may comprise a fixing hook and/or the second part may comprise a fixing tab, the fixing hook being inserted into or under the through-opening in the second part and the fixing tab engaging in the housing of the first part, the fixing tab cooperating with the fixing hook in order to keep the second part folded over the first part. Preferably, the fixing tab has a tooth which, during the folding of the second part over the first part, engages with the fixing hook by snap-fastening.

Preferably, one of the fixing hook and the fixing tab, in particular the fixing tab, is flush with the surface of one of the main faces.

In a further variant, the first and the second part are not fixed together but only folded together. The first and second parts are then held for example by the introduction of the end piece of the applicator member into a recess in a stem, the end piece fitting for example tightly in the recess or the stem being crimped by the end piece, such that the two half end pieces, and as a result the first and the second part, are kept pressed together.

In one way or another, the second part remains fixedly engaged in the housing of the first part.

A further subject of the invention, according to another of its aspects is thus an applicator member for applying a cosmetic product to human keratin materials, comprising an applicator head having two opposite faces, the applicator head comprising:

a first part having at least one housing, and a second part that is connected to the first part by a hinge, is at least partially engaged in the housing of the first part, and contains the product to be applied so as to allow application of the cosmetic product on first use without the need for a reservoir separate from the applicator member.

Preferably, according to this second aspect of the invention, the first and second parts are both accessible from each of the main faces of the applicator head, as for the applicator member defined above.

According to a third aspect, a subject of the invention is an applicator member for applying a cosmetic product to the eyelashes and/or eyebrows, comprising an applicator head having:

a first part having at least one housing, and a second part that is connected to the first part by a hinge and is at least partially engaged in the housing of the first part, the second part comprising spikes, the first part comprising a flocked coating.

The applicator head may have a face onto which the housing opens, the flocked coating extending for example all around the opening of the housing or along the housing, on one side or both sides thereof.

A further subject of the invention, according to another of its aspects, is a device for applying a product to human keratin materials, comprising:

a stem, an applicator member according to the invention, according to the first or the second aspect as defined above, the applicator member being fixed to the end of the stem.

The end piece of the applicator member is preferably inserted into an open recess at the end of the stem.

Preferably, the device comprises a container containing the cosmetic product to be applied. This container may comprise a wiping member.

The device can serve for the application of the product to the skin and/or the lips. In a variant, the device is configured for the application of the product to the eyelashes and/or eyebrows.

The container may contain a product to be applied to the skin and/or the lips, in particular a foundation, an eyeshadow, a concealer product, a complexion corrector, a lipstick, or a lip gloss, or a product to be applied to the eyelashes and/or eyebrows, in particular mascara.

A further subject of the invention, according to another of its aspects, is a method for manufacturing an applicator member according to the invention, comprising the steps of:

moulding a body of the applicator member in the open state, comprising a first part having at least one housing, and a second part that is connected to the first part by a hinge and is intended to be engaged in the housing after the second part has been folded over the first part, applying an adhesive to one of the first and the second part, preferably to the first part, applying flocking bristles to the adhesive, folding the second part over the first part so that the second part is at least partially engaged in the housing of the first part.

Preferably, the body of the applicator member comprises two half end pieces that are attached at their distal ends to the first and the second part, respectively, and are connected together at their proximal ends by the hinge.

The second part can be fixed to the first part by snap-fastening or force-fitting. In a variant, the second part and the first part are only folded together and kept in this state by an additional means, for example a stem into which the end piece is inserted.

A further subject of the invention is a method for manufacturing a device according to the invention, comprising the step of fixing the applicator member as defined above to a stem, for example by insertion of the end piece into an open housing at the end of the stem.

Figure 2:
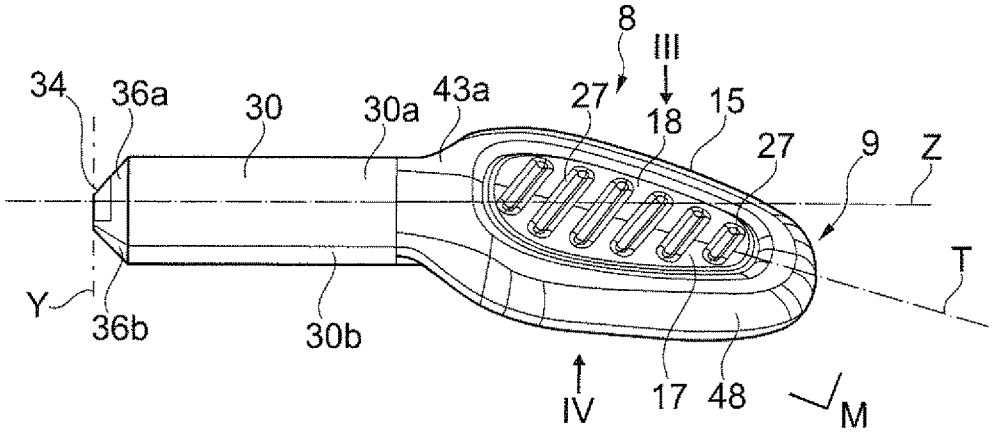
Figure 3:
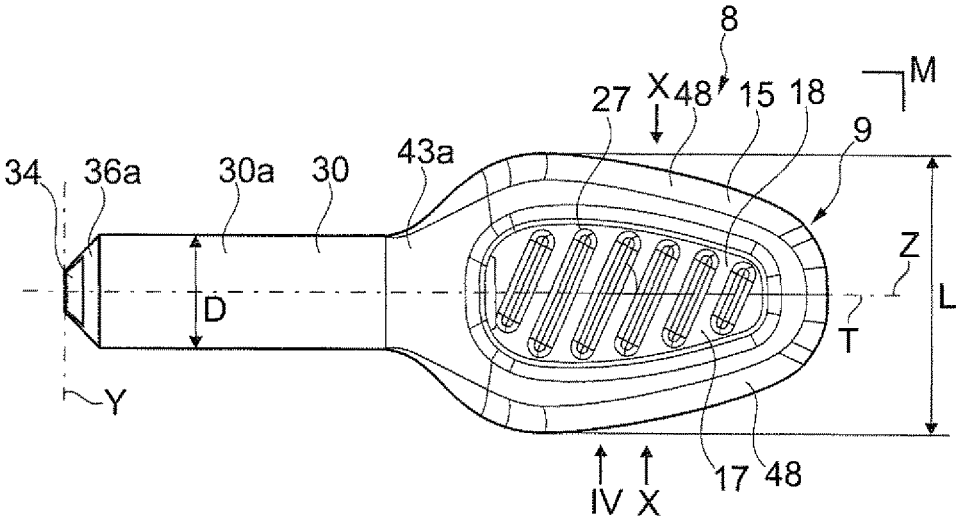
Figure 4:
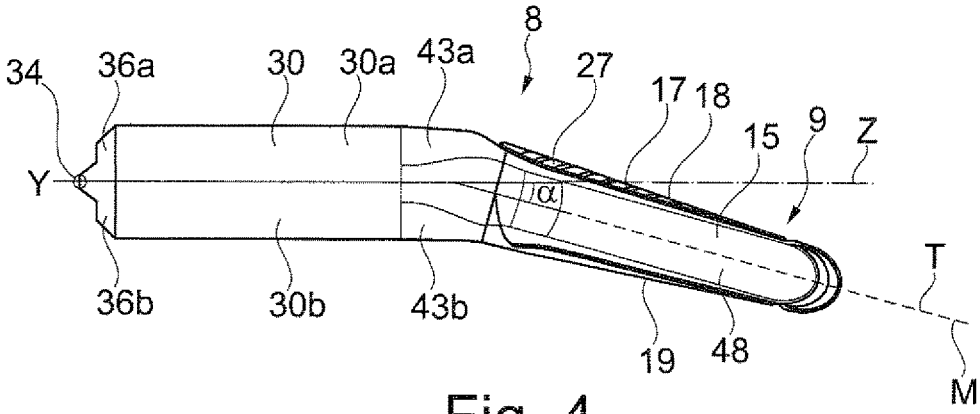
Figure 5:
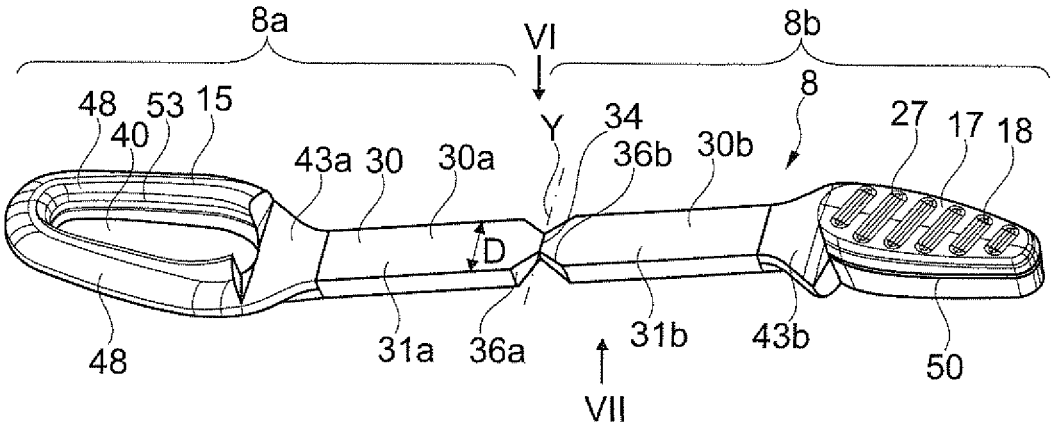
Figure 6:
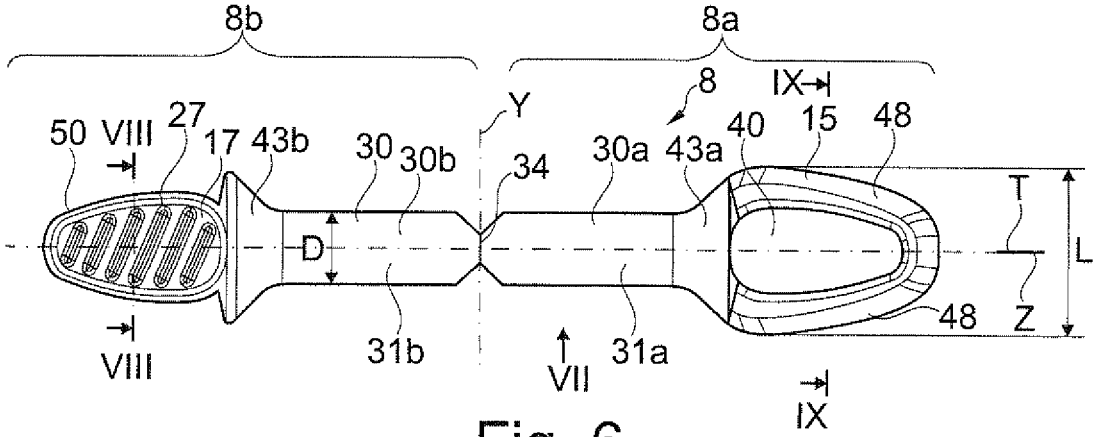
Figure 7:
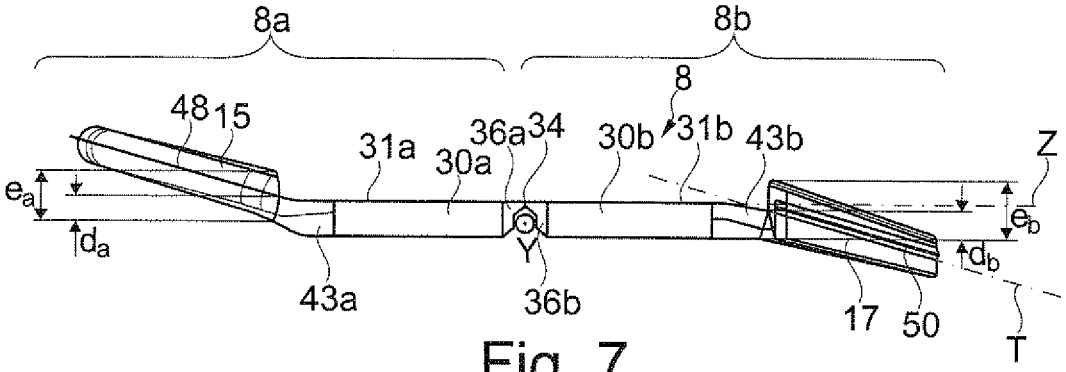
Figure 8:
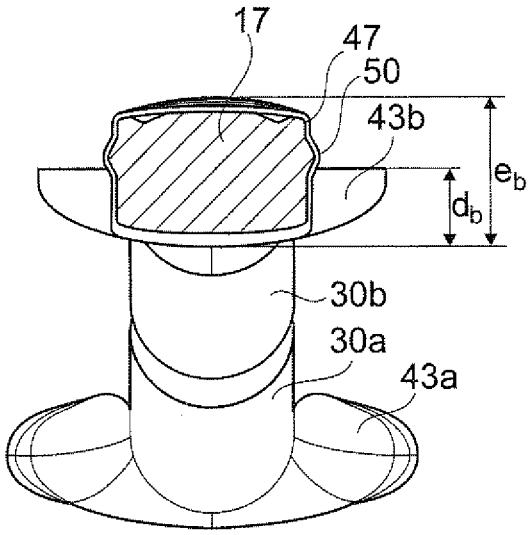
Figure 9:
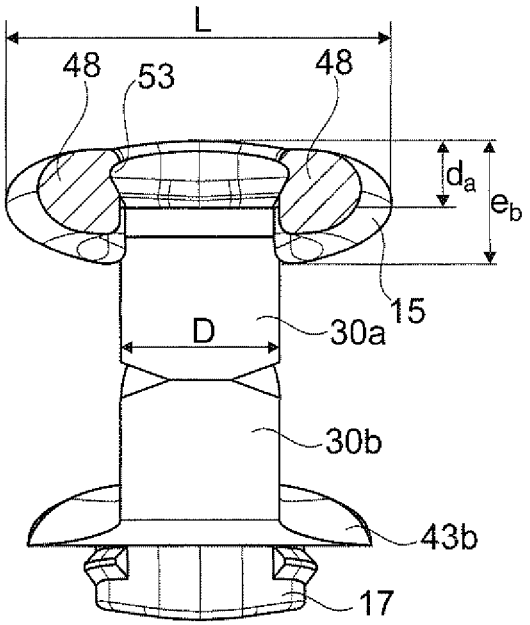
Figure 10:
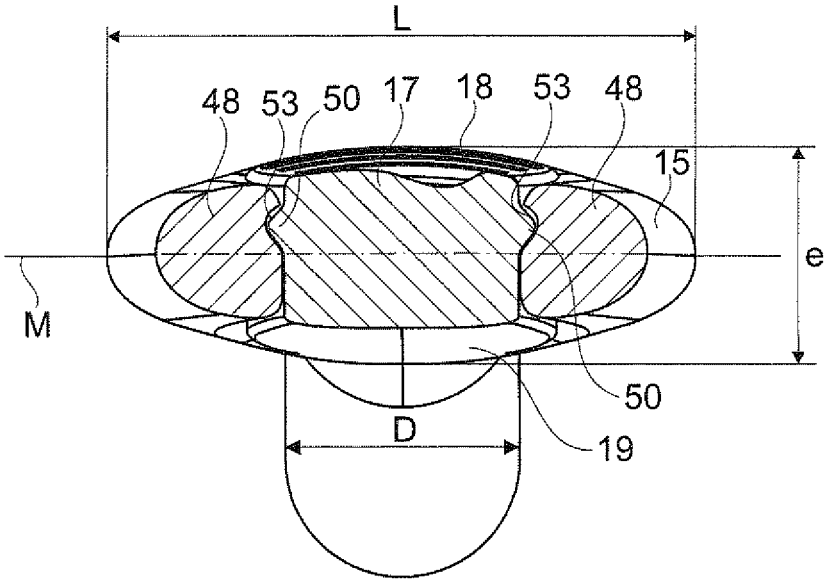
Figure 11:
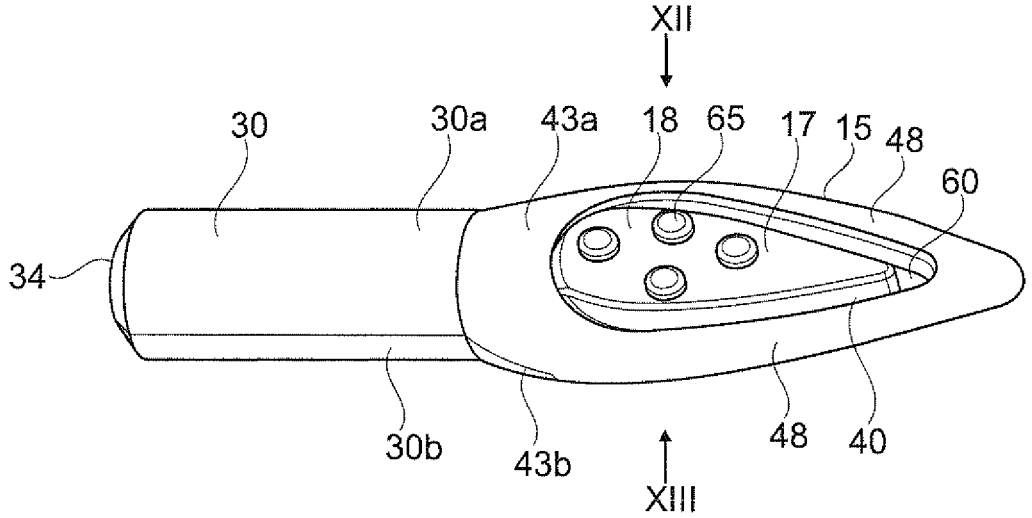
Figure 12:
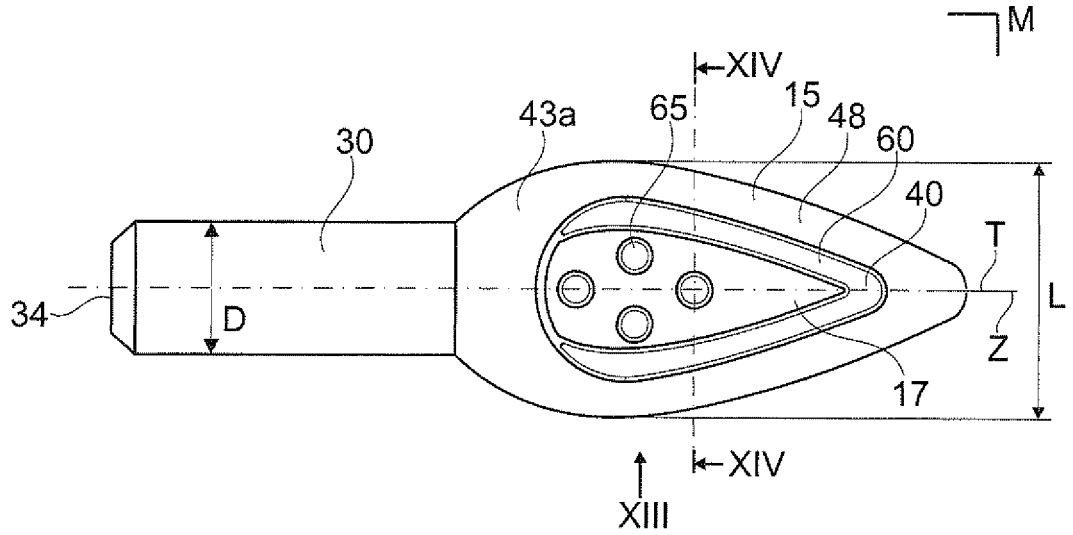
Figure 13:
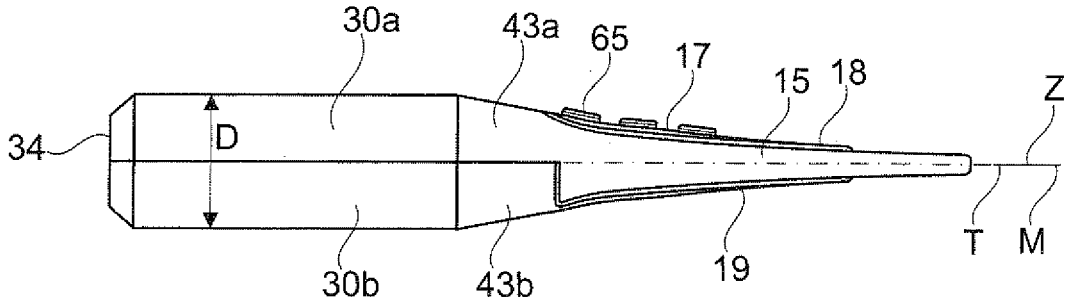
Figure 14:
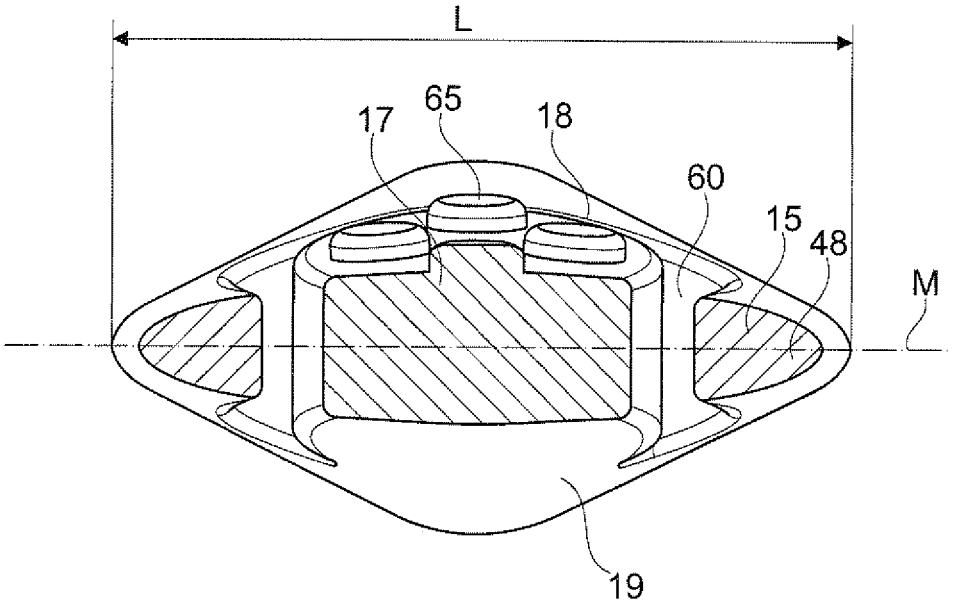
Figure 15:
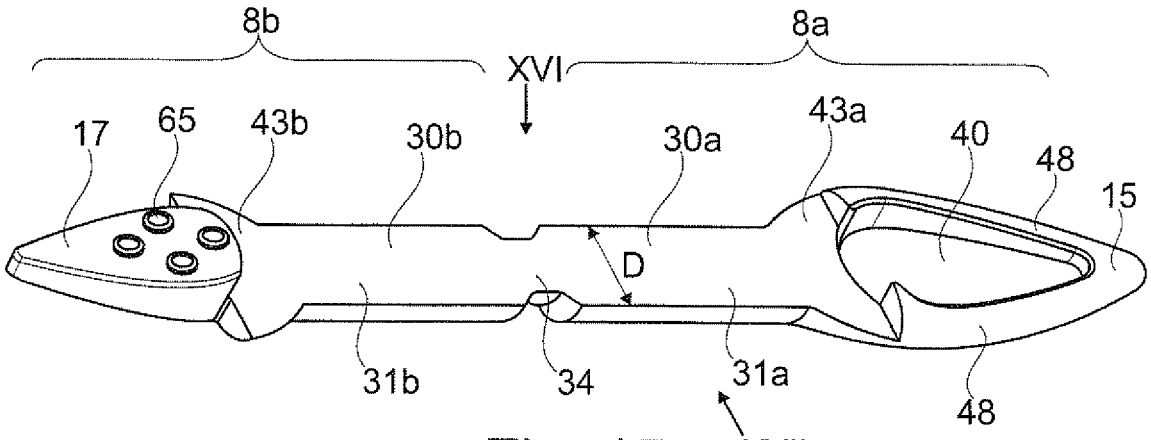
Figure 16:
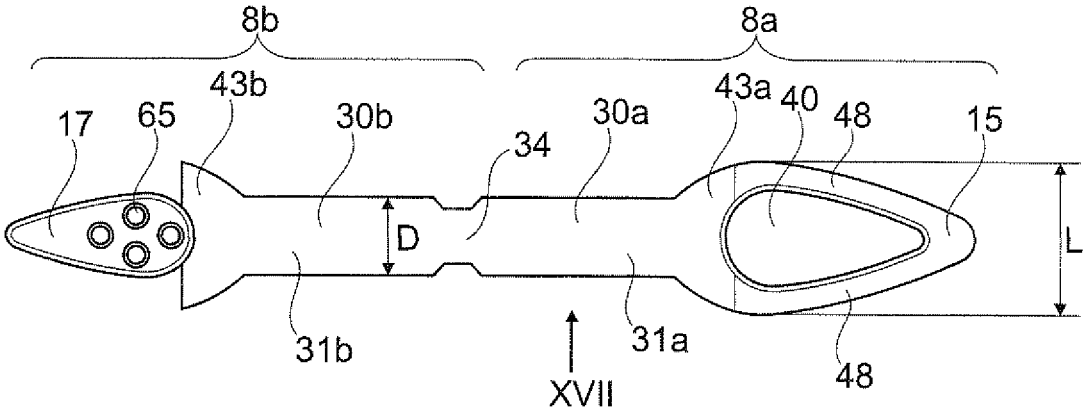
Figure 17:
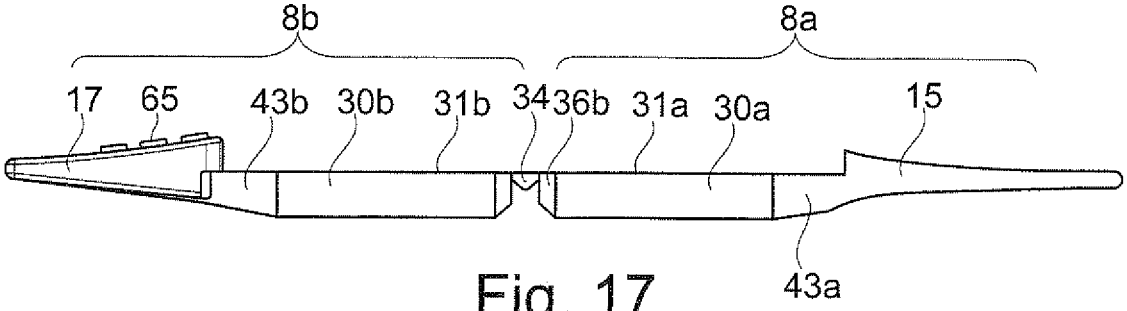
Figure 18:
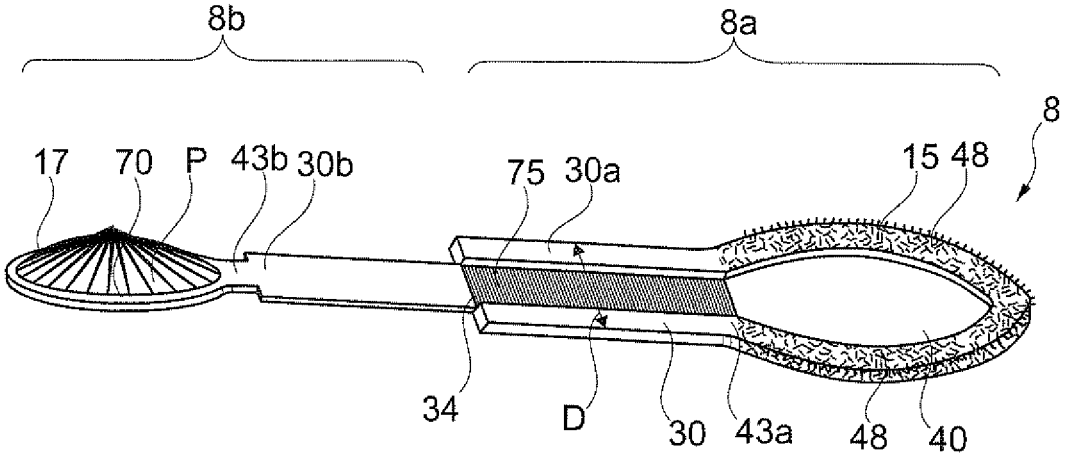
Figure 19:
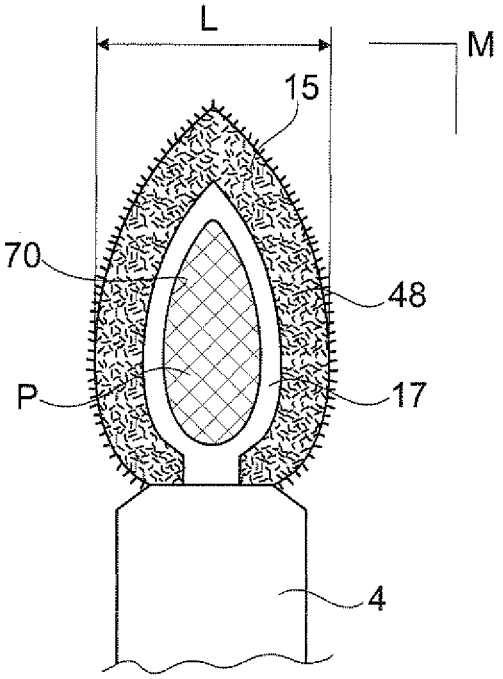
Figure 26:
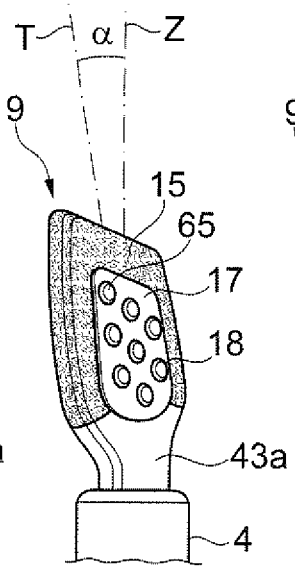
Figure 27:
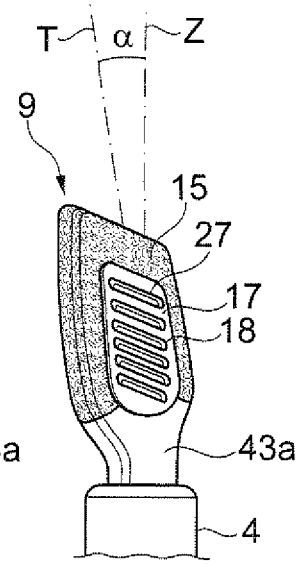
Figure 28:
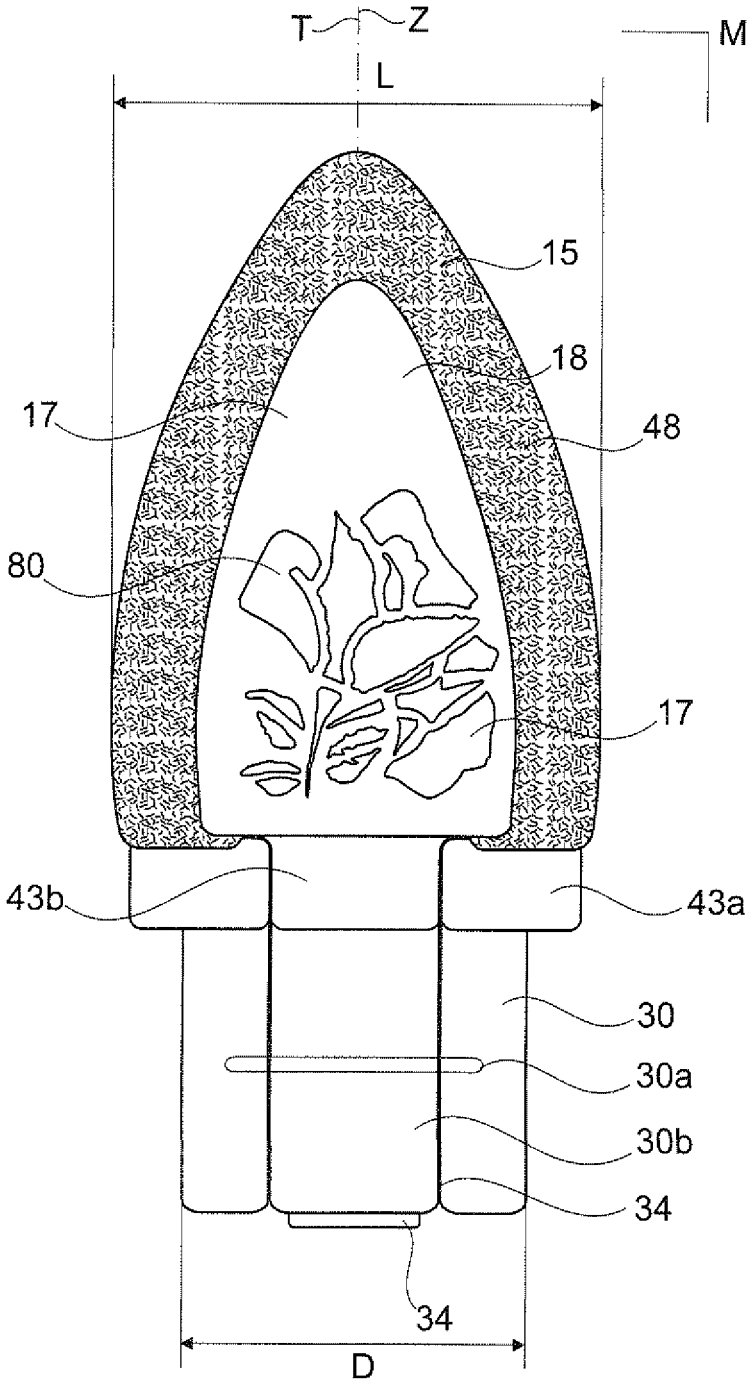
Figure 29:
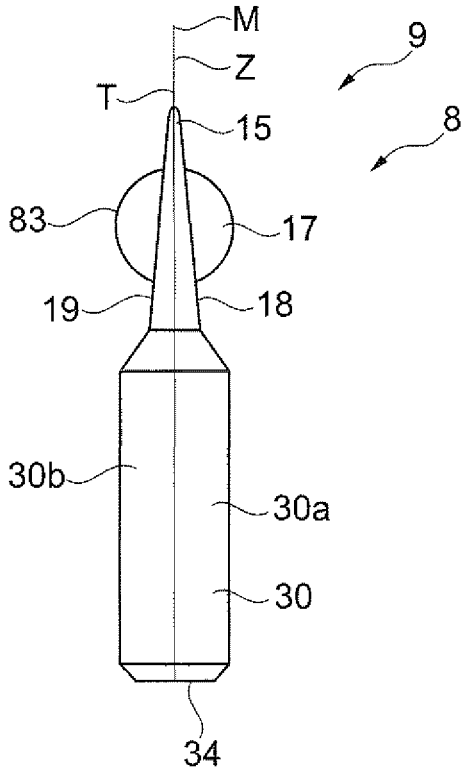
Figure 30:
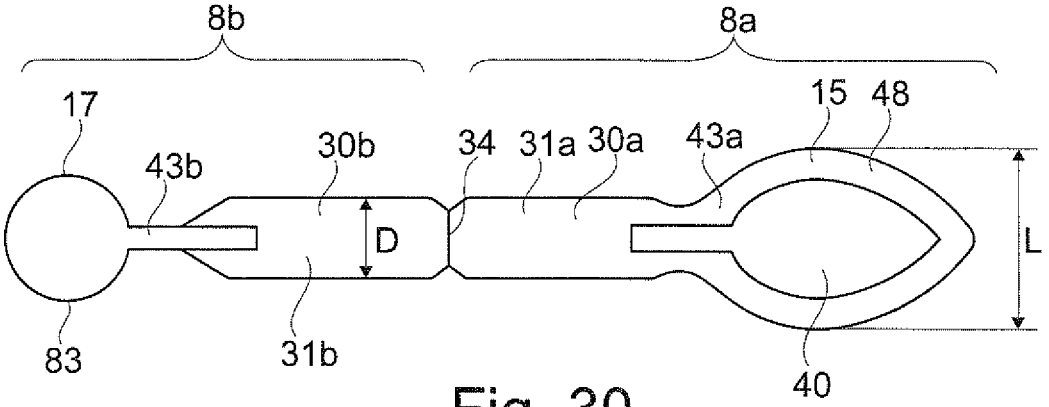
Figure 31:
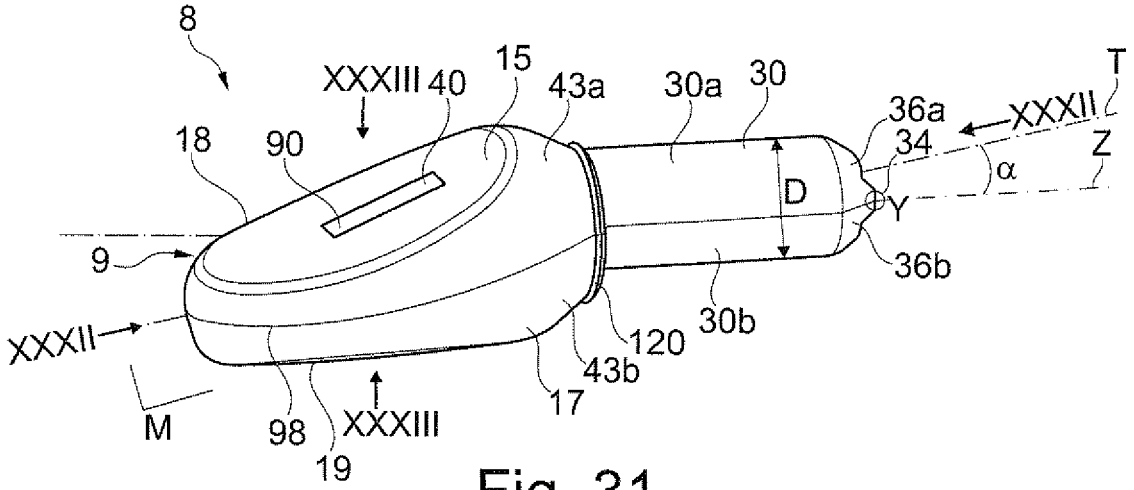
Figure 32:
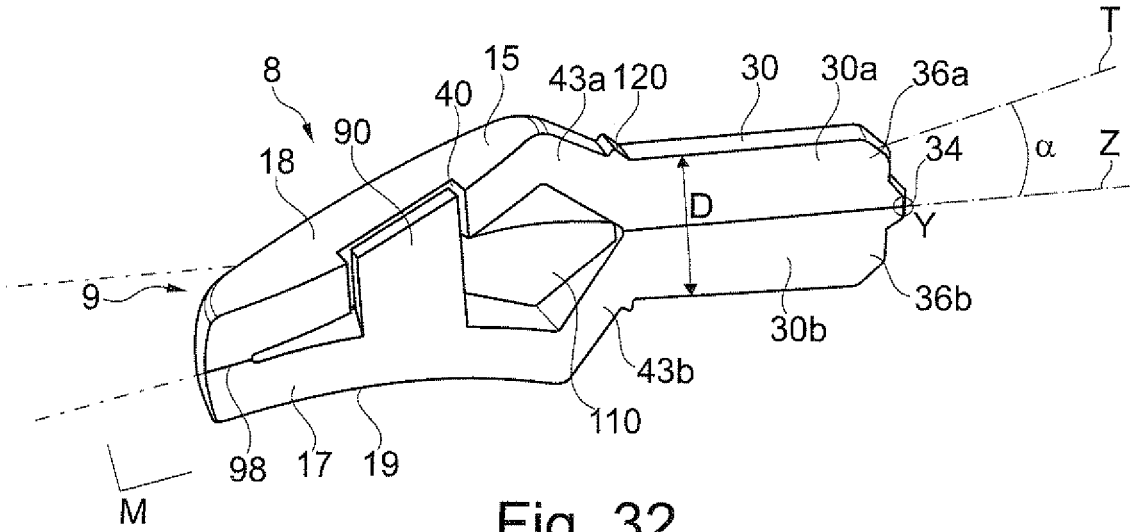
Figure 33:
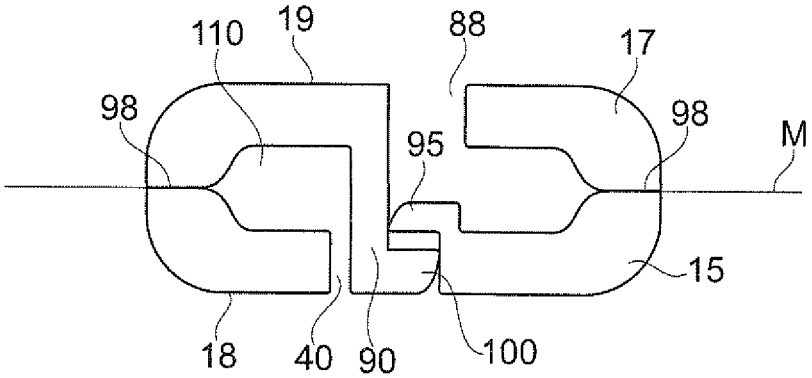
Figure 34:
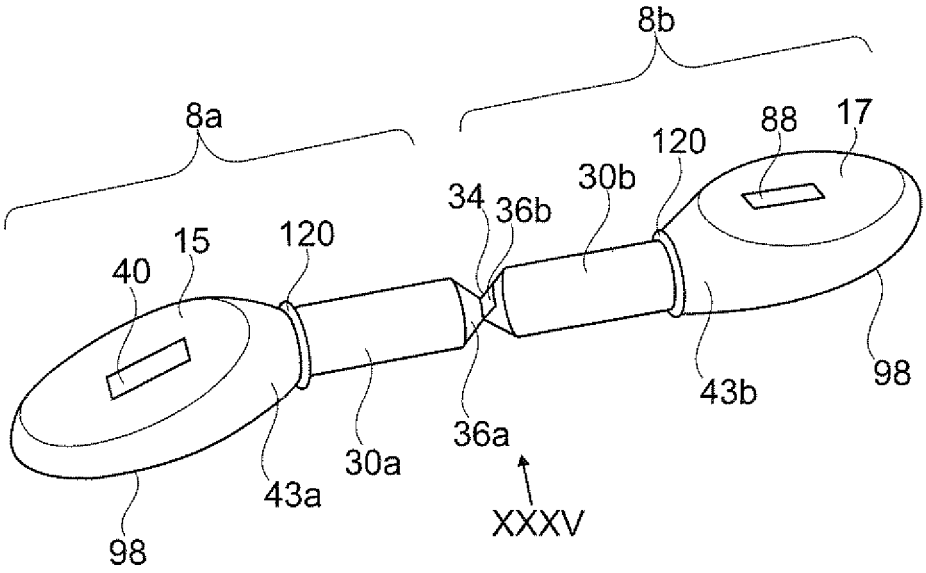
Figure 35:
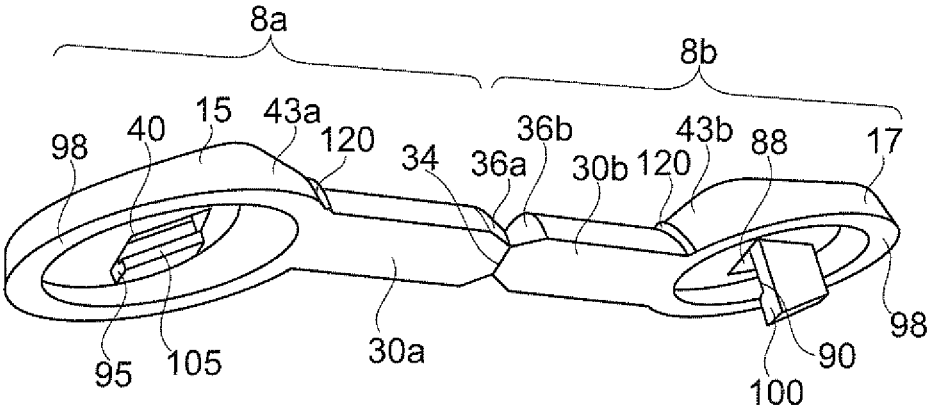
Figure 68:
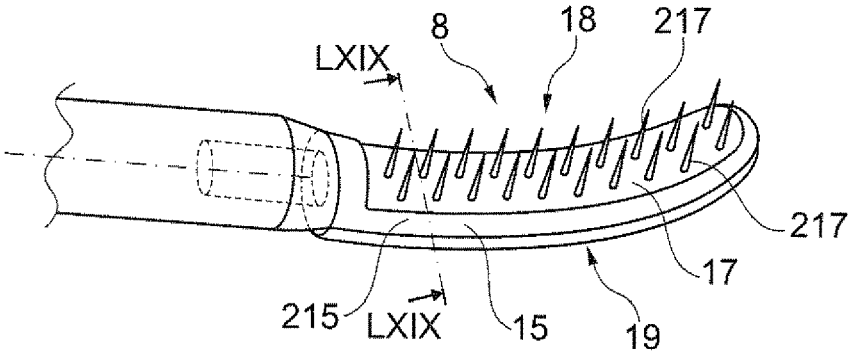
Figure 69:
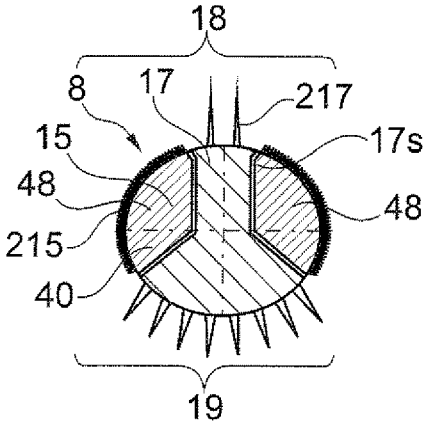
Figure 70:
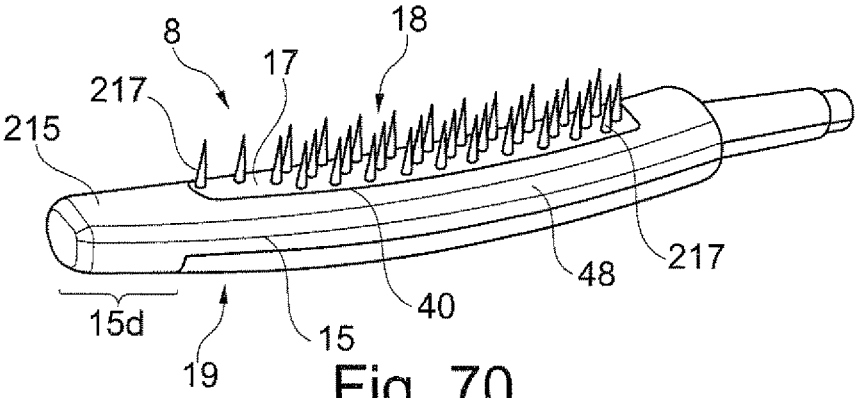
Figure 71:
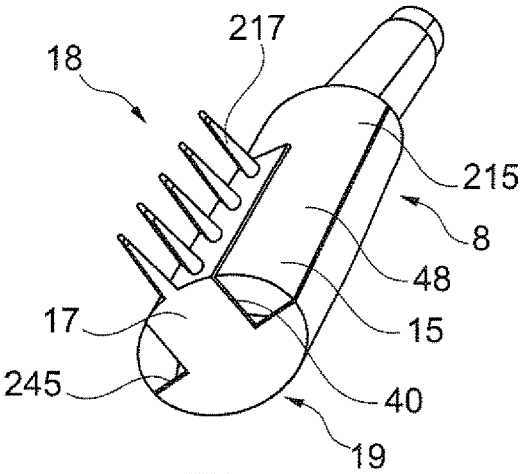
Figure 72:
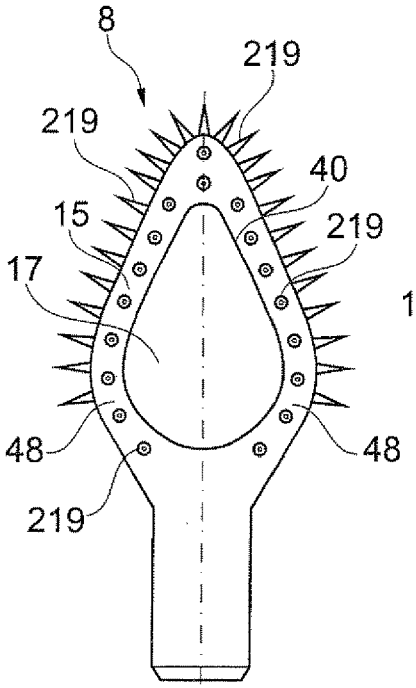
Figure 73:
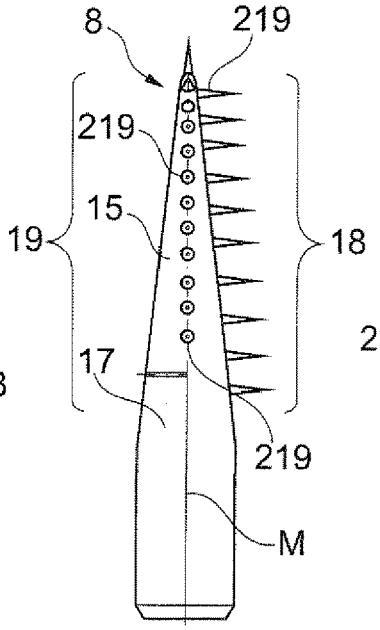
Figure 74:
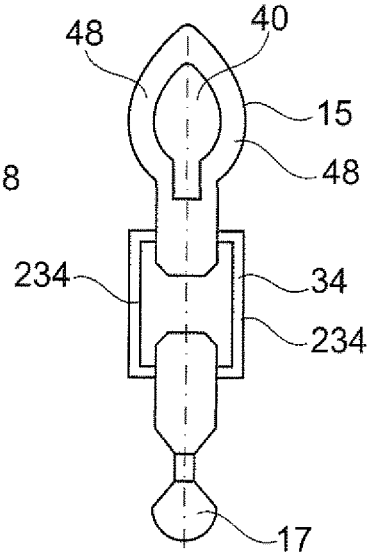

The invention may be better understood from reading the following detailed description of non-limiting illustrative embodiments thereof and from examining the appended drawing, in which:

FIG. 1 shows an example of a packaging and application device according to the invention, FIG. 2 schematically illustrates an example of an applicator member according to the invention, FIG. 3 shows a front view of the applicator member from FIG. 2, along III in FIG. 2, FIG. 4 shows a side view of the applicator member from FIGS. 2 and 3, along IV in FIG. 2, FIG. 5 shows the body of the applicator member from FIG. 2 in the open configuration, FIG. 6 illustrates a top view of the body of the applicator member from FIG. 5, along VI in FIG. 5, FIG. 7 shows a side view of the body of the applicator member from FIGS. 5 and 6, along VII in FIG. 6, FIG. 8 is a cross section on VIII-VIII in FIG. 6, FIG. 9 is a cross section on IX-IX in FIG. 6, FIG. 10 is a cross section on X-X in FIG. 3, FIG. 11 schematically shows a perspective view of a variant embodiment of the applicator member according to the invention, FIG. 12 illustrates a front view of the applicator member from FIG. 11, along XII in FIG. 11, FIG. 13 shows a side view of the applicator member from FIGS. 11 and 12, along XIII in FIG. 11, FIG. 14 is a cross section on XIV-XIV in FIG. 12, FIG. 15 shows the body of the applicator member from FIG. 11 in the open configuration, FIG. 16 is a top view along XVI in FIG. 15, FIG. 17 is a side view along XVII in FIG. 16, FIG. 18 schematically illustrates a variant embodiment of the body of the applicator member, in the open configuration, FIG. 19 schematically and partially shows a front view of the applicator member from FIG. 18, following assembly, FIGS. 20 to 27 are schematic perspective views of variant embodiments of applicator members according to the invention, FIG. 28 shows a front view of another variant of an applicator member, FIG. 29 shows a side view of another variant of an applicator member, FIG. 30 shows the applicator member from FIG. 29 in the open configuration, FIG. 31 is a schematic perspective view of a variant embodiment of an applicator member according to the invention, FIG. 32 is a longitudinal section on XXXII-XXXII in FIG. 31, FIG. 33 is a cross section on XXXIII-XXXIII in FIG. 31, FIG. 34 shows the body of the applicator member from FIG. 31 in the open configuration, FIG. 35 shows a bottom view of the applicator member from FIG. 34, along XXXV, FIGS. 36 to 67 show variants of applicator members according to the invention in cross section, FIG. 68 schematically shows a perspective view of a mascara applicator produced in accordance with the invention, FIG. 69 is a cross section through the applicator from FIG. 68 on LXIX-LXIX, FIG. 70 shows a perspective view of a variant of an applicator member, FIG. 71 is a view with a cross section through the applicator from FIG. 70, FIG. 72 shows a front view of a variant of an applicator member, FIG. 73 is a side view of the applicator from FIG. 72, and FIG. 74 illustrates a variant embodiment of the hinge.

The packaging and application device 1 illustrated in FIG. 1 comprises a container 10 containing a product P to be applied and an applicator 3 for taking up and applying the product contained in the container.

The applicator 3 comprises a stem 4 of longitudinal axis X, bearing at one 5 of its ends an applicator member 8 comprising an applicator head 9. As can be seen in FIGS. 2 to 4, the applicator head 9 comprises a first part 15 and a second part 17 that is engaged in the first part 15, these two parts being connected together by a hinge 34.

In the example illustrated, the axis X of the stem 4 is rectilinear, but it could be curved in a variant.

The container 10 may comprise in its upper part a neck 21, as illustrated. A wiping member 24 is engaged in this neck 21.

As illustrated in FIG. 1, the stem 4 is provided at its other end 6 with a gripping element 13 that also forms a cap for leaktight closure of the container 10.

The distal end 5 of the stem 4 has a recess which receives a mounting end piece 30 of the applicator member 8.

The applicator head 9 extends along a longitudinal axis T and is attached to the end piece 30. The latter is formed by two half end pieces 30*a* and 30*b* that are in contact with one another and connected together by the hinge 34.

The two half end pieces 30*a* and 30*b* are connected to the first part 15 and to the second part 17, respectively. The end piece 30 can be held in the stem 4 by any means, in particular by adhesive bonding, force-fitting, stapling, screw-fastening, crimping or snap-fastening.

Preferably, the two half end pieces 30*a* and 30*b* each have a flat face 31*a* and 31*b*, the latter coming into contact with one another over their entire surface area. In a variant, these faces comprise one or more reliefs that cooperate, for example by snap-fastening.

Thus, the possibility for one of the half end pieces 30*a* or 30*b* to comprise a recessed relief 75 for receiving the other half end piece has been illustrated in FIG. 18.

Preferably, the end piece 30 is in the form of a cylinder of revolution in the case of mounting in a stem. The end piece can be realized in a different manner, in particular when it is intended to serve directly for gripping.

Preferably, the hinge 34 is disposed at those ends 36*a* and 36*b* of the two half end pieces 30*a* and 30*b* that are away from the first and second parts 15 and 17. It allows the two parts 15 and 17 and the two half end pieces 30*a* and 30*b* to be moulded in the open configuration in one piece and to be assembled by the second part 17 and the half end piece 30*b* being rotated about an axis Y of the hinge 34, perpendicular to the longitudinal axis Z of the end piece 30, as illustrated in FIGS. 5 to 7.

The applicator head 9 can be flatted overall in a plane M perpendicular to the plane of FIG. 4 and defines two opposite main faces 18 and 19. Preferably, the applicator head 9 has a greatest width L which is greater than that D of the end piece 30.

The first part 15 can be flocked, as illustrated in FIG. 1, and the second part 17 can comprise reliefs such as a plurality of ribs 27, as illustrated in FIG. 2. The ribs 27 extend preferably obliquely relative to the longitudinal axis T, forming an angle β with the longitudinal axis T.

The longitudinal axis T of the applicator head 9 preferably forms an angle α of preferably less than 45°, better still between 10 and 45°, with the longitudinal axis Z of the end piece 30.

As illustrated in FIGS. 5 to 7, the first and second parts 15 and 17 can each be attached to a respective half end piece 30*a* or 30*b* by way of a corresponding intermediate portion 43*a* or 43*b* which widens in the direction of the associated part. Preferably, the intermediate portions 43*a* and 43*b* are symmetrical such that when they are folded one over the other, the applicator member 8 has no discontinuities in its portion extending between the end piece 30 and the applicator head 9.

The hinge 34 is preferably a film hinge, as illustrated in FIGS. 5 to 7.

In the example in question, the first part 15 comprises two arms 48 that meet at their ends and define between one another a housing 40, in particular a through-housing, for receiving the second part 17. Preferably the first part 15 surrounds the second part 17 when the applicator member is viewed from the front, as in FIG. 3.

The housing 40 and the second part 17 have for example an approximately oval contour, as illustrated.

The second part 17 may entirely fill the housing 40.

The applicator head 9 can narrow slightly towards its free end, as illustrated in FIGS. 4 and 7.

As can be seen in particular in FIGS. 8 and 9, the first and second parts 15 and 17 can have respective thicknesses $e_a$ and $e_b$ which are greater than those $d_a$ and $d_b$ of the intermediate parts 43*a* and 43*b*.

The total thickness e of the applicator head can be less than its greatest width L, as can be seen in FIG. 10.

As illustrated in FIG. 8, the second part 17 can have an approximately rectangular cross section and comprise a rib 50 at its periphery 47.

It can be seen in FIG. 9 that each arm 48 of the first part 15 can comprise a corresponding groove 53.

As illustrated in FIG. 10, the rib 50 is snap-fastened, during the folding the second part 17 over the first part 15, into the groove 53 in order to keep the applicator 8 in the closed position.

This does not have to be the case, and in particular the first part 15 can comprise a rib that is snap-fastened into a groove in the second part 17, or it is possible for the first and the second part 15 and 17 not to have any relief for snap-fastening.

FIGS. 11 to 17 show a variant embodiment of the invention, which differs from the one described with respect to FIGS. 1 to 10 mainly by the shape and size of the second part 17.

As can be seen in FIGS. 11 to 13, the second part 17 can only partially fill the housing 40 such that a space 60 remains, in the applicator head 9, between the first part 15 and the second part 17, this allowing product to collect on the applicator head 9.

The second part 17 can have protruding reliefs 65, in particular bosses, in particular having a circular contour in front view, making it possible to exert a massaging action on the skin or the lips.

The two portions 8*a* and 8*b* can be kept in place by the insertion of the applicator member S into the recess in the stem 4. The two half end pieces 30*a* and 30*b* are then clamped together.

FIGS. 18 and 19 show a variant embodiment which differs from the example in FIGS. 1 to 10 by the shape of the second part 17.

The latter comprises a cavity 70, which is not a through-cavity, containing the cosmetic product P, which is thus only accessible from one side of the applicator member.

The cosmetic product P is for example of the eyeshadow, foundation, rouge or lip-gloss type, or mascara.

One of the half end pieces 30*a* and 30*b* can be wider than the other. For example, a recessed relief 75 extends along the half end piece 30*a* in order to receive the half end piece 30*b*.

Figure 20:
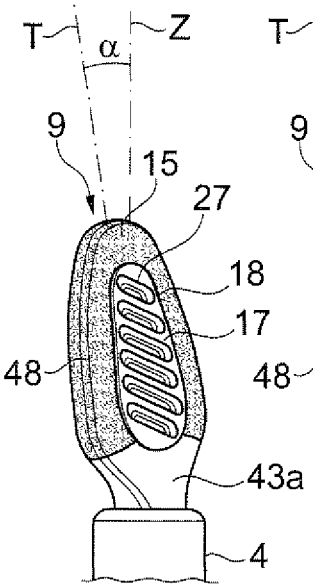
Figure 21:
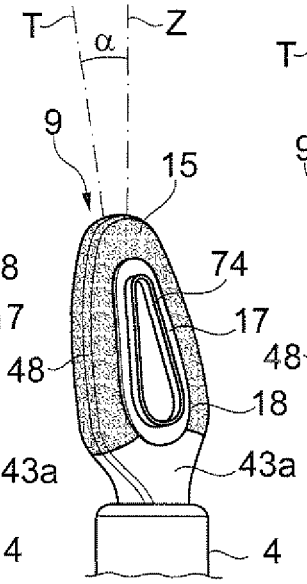
Figure 22:
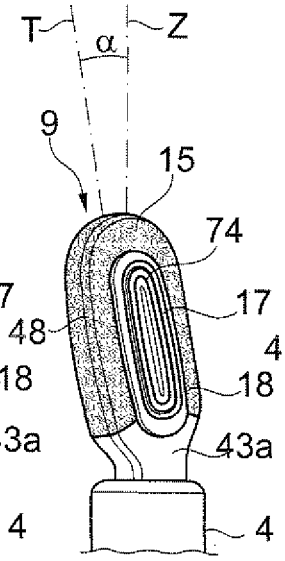
Figure 23:
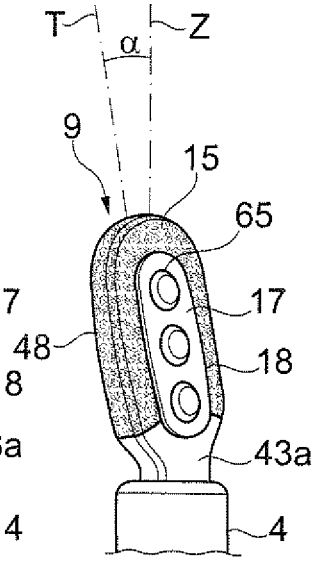
Figure 24:
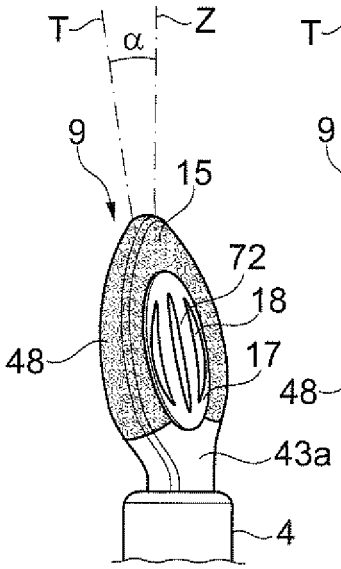
Figure 25:
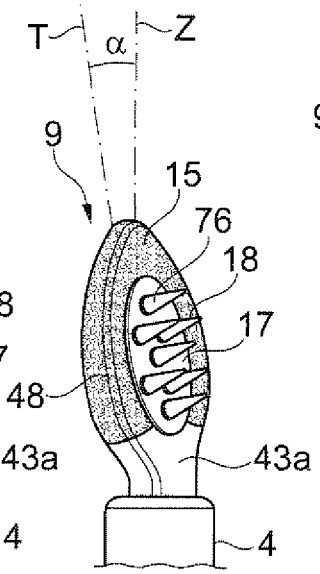

In the variants illustrated in FIGS. 20 to 27, the second part 17 comprises protruding or recessed reliefs of different shapes, in particular bosses 65, as illustrated in FIGS. 23, 25 and 26, oblique or transverse ridges 27, as illustrated in FIGS. 20 and 27, longitudinal grooves 72, as illustrated in FIG. 24, cavities 74, as illustrated in FIGS. 21 and 22, or spikes 76, as illustrated in FIG. 25.

When viewed from the front, the contour of the applicator head, along a major part of the length which is flocked, may be approximately elliptical, as illustrated in FIGS. 24 and 25, rectangular, as illustrated in FIGS. 26 and 27, have parallel side edges connected by a rounding, as in FIGS. 22 and 23, or have outwardly convex edges connected by a rounding, as in FIGS. 20 and 21.

In the variant illustrated in FIG. 28, the second part 17 bears a relief 80 or an impression representing a decorative logo or an inscription that helps the user to get his/her bearings during use.

In the example in this figure, the end piece serves to be gripped directly by the user.

The end piece 30 can still be inserted into a covering element that serves as a gripping member. This embodiment makes it possible in particular to apply foundation.

In the variant illustrated in FIGS. 29 and 30, the second part 17 is in the form of a bulge 83, for example in the form of a ball, which is housed in the housing 40 delimited by the first part 15 so as to protrude from both sides of the housing 40 in side view. This bulge 83 can make it possible to massage the keratin materials.

FIGS. 31 to 35 illustrate a variant embodiment of the invention, which differs from the one described with respect to FIGS. 1 to 10 mainly by the shape of the two parts and the manner in which they are fixed.

The first and second parts 15 and 17 have similar dimensions and, in the folded position, come into contact with one another.

The second part 17 comprises a through-opening 88, visible in FIG. 33 and a fixing tab 90 that is engaged in the housing 40. This fixing tab 90 has a tooth 100.

The first part 15 comprises a fixing hook 95 which, when the applicator member is in the folded position, is disposed in or under the through-opening 88 in the second part 17, such that it remains visibly accessible from the face 19. The fixing tab 90, in particular the tooth 100, and the hook 95 come into engagement with one another, as illustrated in FIG. 33.

In this example, the first and the second part 15 and 17 define, in the folded position, a free space 110 in the applicator head 9.

Preferably, as illustrated, the fixing tab 90 is flush with the face 8, such that, when the applicator member is used, the keratin materials can come into contact with its end.

As illustrated in FIGS. 31 to 35, the applicator member can comprise a flange 120 that serves as an end stop for insertion into the stem, this flange 120 being formed between the intermediate parts 43*a* and 43*b* and the half end pieces 30*a* and 30*b*.

FIGS. 36 to 59 show various examples of arrangements of the first 15 and second 17 parts of the applicator head in cross section.

In these figures, the residual clearance between the first and second parts may have been exaggerated for the sake of clarity.

Figure 36:
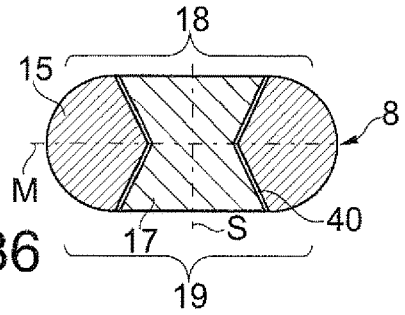

In the example in FIG. 36, the applicator head has a flattened overall shape along a flattening plane M. As illustrated, the second part 17 has for example a cross section in the overall shape of an hourglass, which is held by complementing shapes in the housing 40 of the first part 15. The applicator part may have a symmetrical shape with respect to a plane of symmetry S which may be perpendicular to the flattening plane M.

Figure 37:
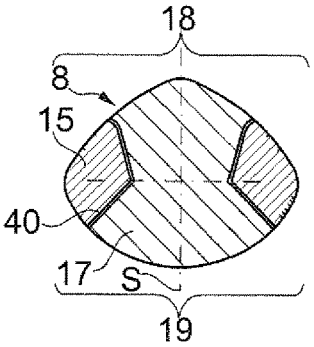

In the example in FIG. 37, the applicator head has the overall shape of an almond in cross section. The extents taken up by the second part on each of the opposite faces 18 and 19 of the applicator head may be different. In the example illustrated, the second part 17 thus takes up a smaller portion of the face 18 than of the face 19, the part 17 being wider at its base. The portion of the application surface that is defined by the second part 17 may have a smaller radius of curvature on the side of the face 18 than on the side of the face 19. In FIG. 37, the applicator head has a symmetrical shape with respect to the plane of symmetry S, but, in a variant that is not illustrated, the applicator head has an asymmetrical shape with respect to the median plane that intersects it half-way along its length.

As in the example in FIG. 36, the second part has a narrowing of its section between the faces 18 and 19, this keeping the second part in place in the housing 40. The plane in which the second part becomes narrowest may coincide, as illustrated, as the plane in which the first part 15 is at its widest. In the example in FIG. 37, the applicator head has a section which is asymmetrical with respect to a plane that intersects it half-way through its thickness.

Figure 38:
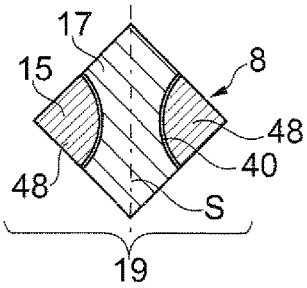

In the example in FIG. 38, the applicator head has a cross section which has a polygonal overall shape and more particularly, in the example in question, a square shape. The housing 40 in which the second part 17 is received may be defined between two arms 48 that have convex facing surfaces that are for example approximately in the form of a quarter circle. When the applicator head has a cross section with a polygonal overall shape, it can be symmetrical with respect to a median plane that intersects it half-way through its thickness, as illustrated. In a variant that is not illustrated, the applicator head has a cross section in the faun of an irregular polygon.

Figure 39:
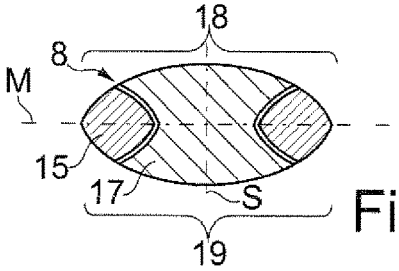

In the example in FIG. 39, the applicator head has a cross section which has an oval, for example elliptical, overall shape. The major axis of the section may be contained in a median plane M that intersects the applicator head half-way through its thickness. The applicator part may have a symmetrical overall shape with respect to a plane of symmetry S perpendicular to the median plane M.

Figure 40:
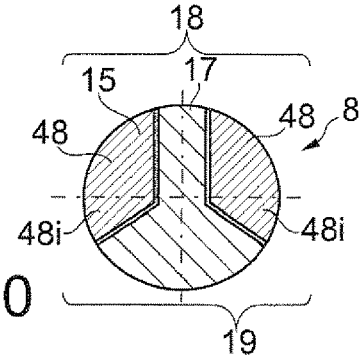

In the example in FIG. 40, the applicator head has a circular overall shape in cross section; it can be seen in this figure that the second part 17 can take up an area of the surface of each face 18 or 19 which is different depending on the face in question. Thus, in the example illustrated, the second part takes up a narrow central strip on the face 18 and virtually the entire face on the face 19, the rest of the latter being defined by the lower portions 48*i* of the arms 48.

Figure 41:
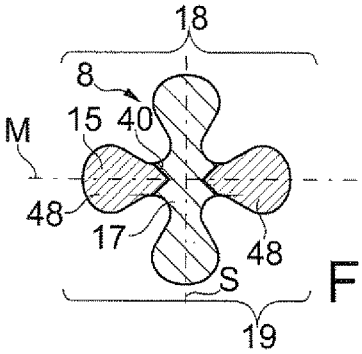

In the example in FIG. 41, the applicator head has a multilobe overall shape in cross section, with for example, as illustrated, four lobes. The housing 40 in which the second part 17 is received is defined between the arms 48 which constitute the left-hand and right-hand lobes. The applicator head can have a shape which is symmetrical with respect to a median plane M that intersects it half-way through its thickness and with respect to an orthogonal plane S.

Figure 42:
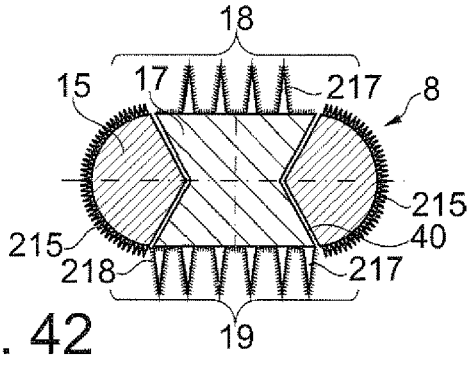

The variant embodiment in FIG. 42 differs from the one in FIG. 36 by way of the presence on the first part 15 of a coating of flocking fibres 215 and by the presence on the second part 17, on each of the faces 18 and 19, of spikes 217, the applicator being more particularly intended for making up the eyelashes and eyebrows. The number of spikes 217 and the disposition and/or shape thereof can differ between the faces 18 and 19; for example, as illustrated in FIG. 42, the number of spikes 217 on the face 18 is smaller than the number of spikes on the face 19.

Figure 43:
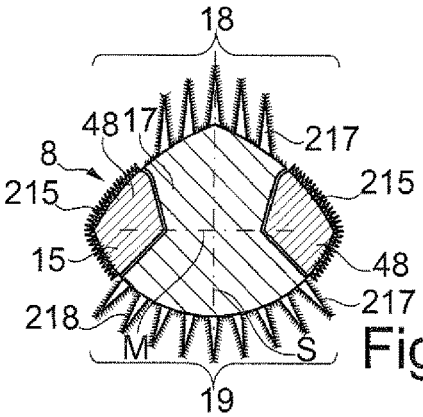

The exemplary embodiment in FIG. 43 differs from the one on in FIG. 37 essentially by presence of a coating of flocking 215 on the opposed faces of the arms 48 of the first part 15 and by the presence of spikes 217 on the second part 17, on the faces 18 and 19.

On the face 18, which corresponds to the upper side of the section in the figure, the spikes 217 are for example all aligned substantially parallel to the plane S, whereas on the face 19, the spikes 217 are oriented substantially radially.

It is also possible, as illustrated in FIGS. 42 and 43, to cover the spikes 217 with a flocked coating 218.

Figure 44:
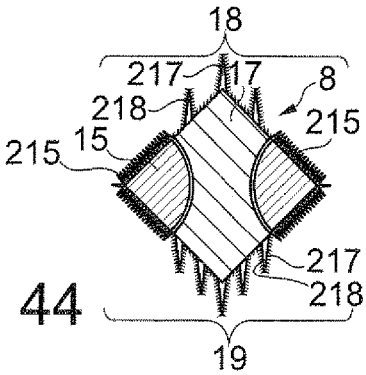
Figure 45:
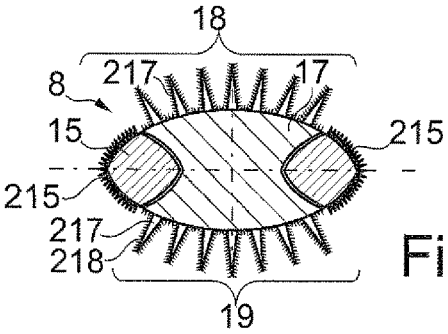

The same goes for the exemplary embodiments in FIGS. 44 and 45, which differ respectively from those in FIGS. 38 and 39 by the presence of the flocked coating 215 of the spikes 217 and of the flocked coating 218. In variants that are not illustrated, the flocked coating 218 is absent.

Figure 46:
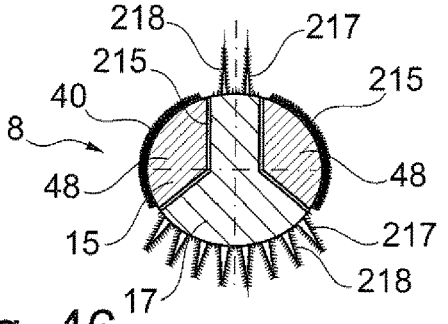
Figure 47:
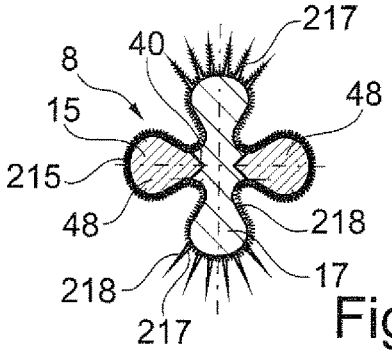
Figure 48:
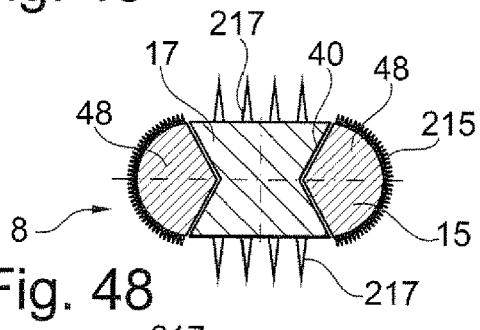
Figure 49:
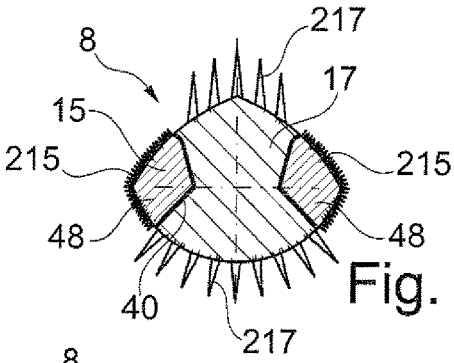
Figure 50:
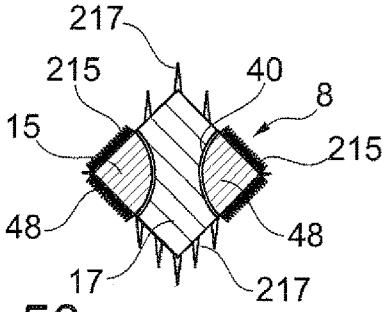
Figure 51:
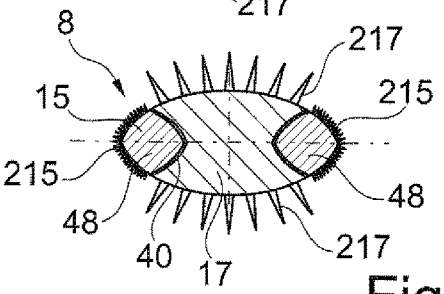
Figure 52:
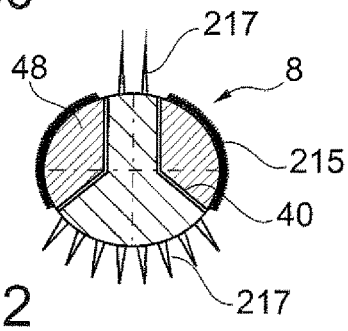
Figure 53:
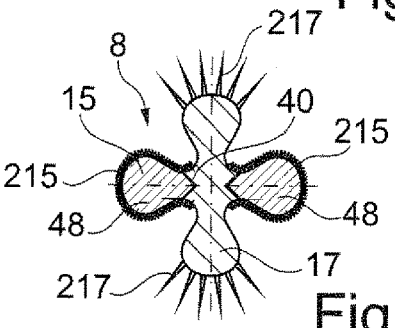
Figure 54:
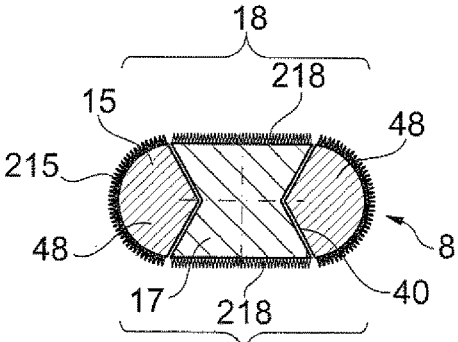
Figure 55:
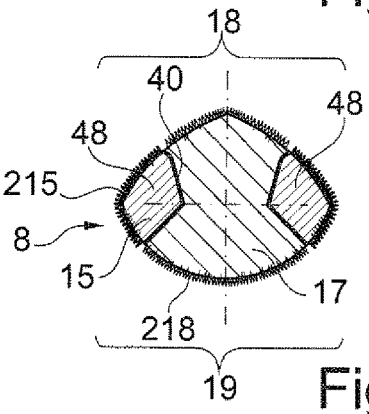
Figure 56:
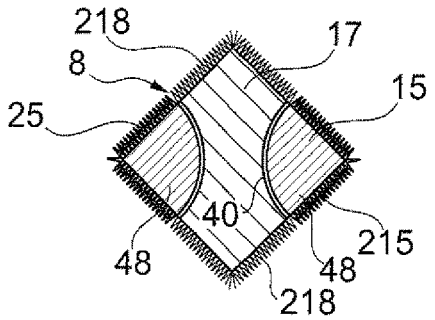
Figure 57:
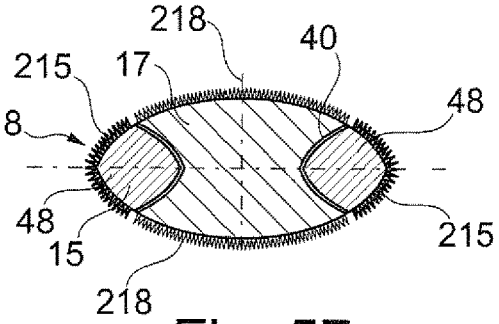
Figure 58:
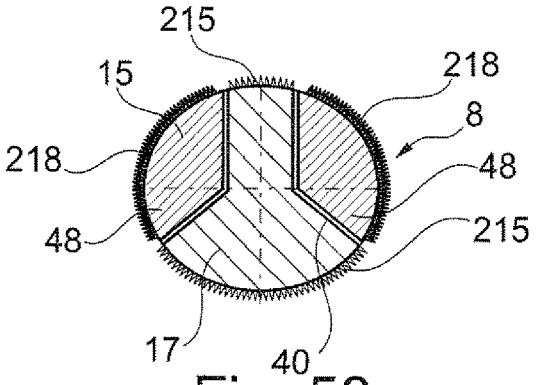
Figure 59:
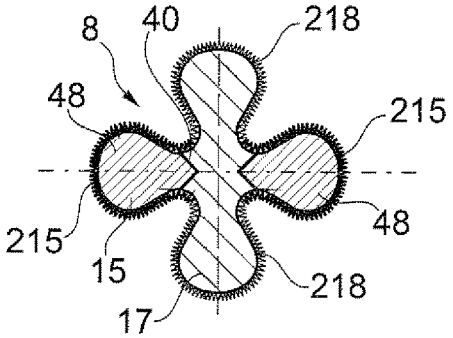
Figure 60:
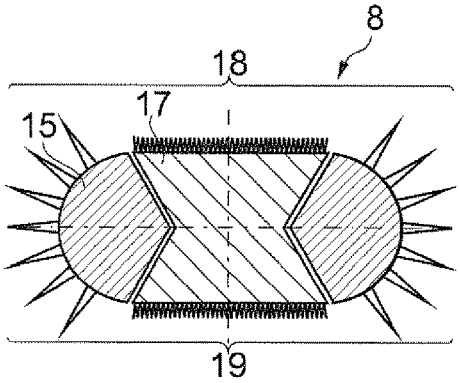
Figure 61:
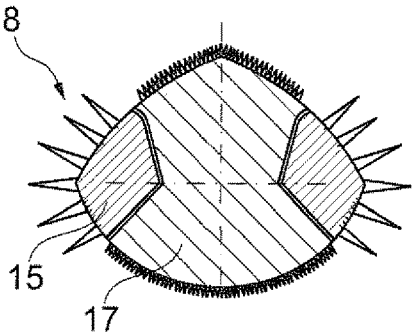
Figure 62:
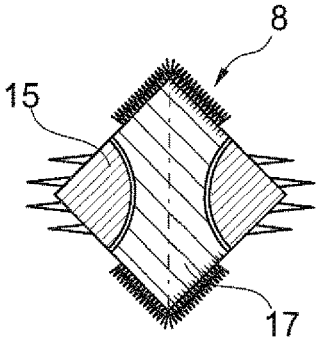
Figure 63:
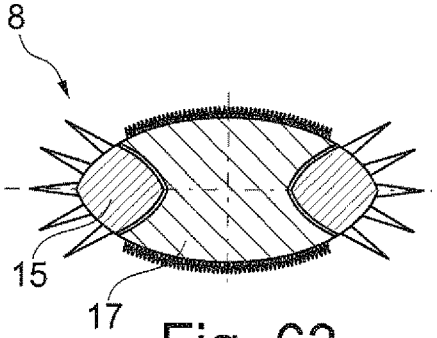
Figure 64:
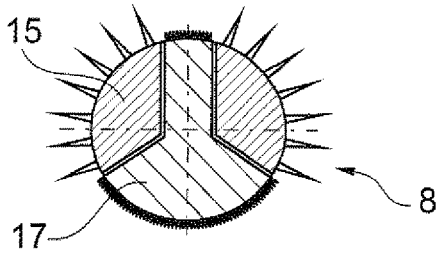
Figure 65:
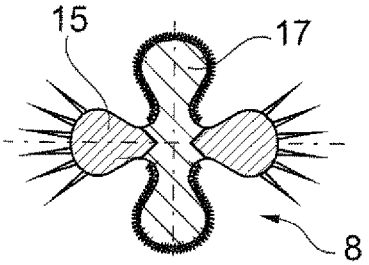
Figure 66:
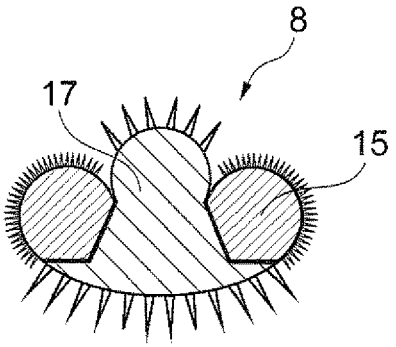
Figure 67:
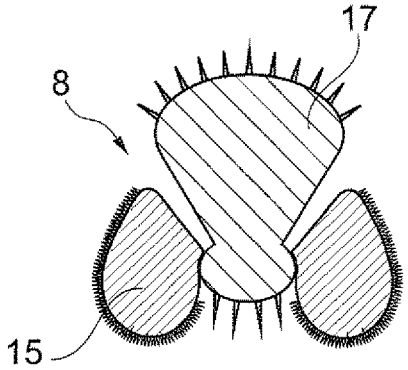

The same goes for the exemplary embodiments in FIGS. 46 and 47. It can be seen in these figures that the flocked coating 218 can cover not only the spikes 217 but also the outer portions of the second part 17, which extend between the spikes or between the latter and the first part 15, as illustrated in FIG. 47 in particular. In the presence of a multilobe second art 17, the spikes 217 are for example oriented substantially radially on each corresponding lobed part. The presence of the grooves formed between one of the lobes of the second part 17 and the two lobes of the first part 15 can allow the product to collect and the autonomy of the applicator to be enhanced.

The examples in FIGS. 48 to 53 differ from those in FIGS. 42 to 47 by the absence of the flocked coating 218 on the second part 17.

The examples in FIGS. 54 to 59 differ from those in FIGS. 36 to 41 by the presence of flocked coatings 215 and 218 on the first 15 and second parts 17.

In the examples illustrated, the flocked coating 218 of the second part 17 does not extend over the surfaces thereof that face the first part 15, in the housing 40. In a variant that is not illustrated, the coating 218 runs onto these surfaces and the assembly of the first and second parts makes it possible to hide the flocked coating that runs onto said surfaces, thereby making it possible to obtain clean contours on each of the faces 18 and 19.

The same may go for the flocked coating 215 which extends over the first part. This coating can run into the housing 40 and be partially hidden by the second part when the latter is in position.

The flocked coatings 215 and 218 of the first 15 and second 17 parts are for example made of flock fibres which differ in terms of their length and/or their diameter, the material used and/or their colour.

Another exemplary embodiment of an applicator member is shown in FIGS. 68 and 69. In this example, the first part comprises two arms 48 that define a housing 40 in which the second part 17 is received, the latter bearing spikes 217 on the side of the face 18, while having no spikes on the side of the face 19 which corresponds to the back of the applicator member. The spikes 217 are for example disposed in one or more rows of spikes, for example two or three longitudinally extending rows. The applicator head can have a curved overall shape which is concave on the side of the face 18. The first part 15 can comprise a flocked coating 215 which extends all around the second part 17 on the side of the face 18, as can be seen in particular in FIG. 68. The second part 17 has an upper part 17*s* which widens, as can be seen in FIG. 69, in order to ensure that the second part 17 is retained in the first 15 by snap-fastening.

The exemplary embodiment in FIGS. 70 and 71 is fairly close to that in FIGS. 68 and 69. However, the face 19 is defined over the major part of the applicator member by the second part 17, the first part 15 only being visible, on the side of the face 19, at the end of the applicator member, over a distal portion 15*d* in which the second part 17 is absent.

The second part 17 can extend, along the portion of its length in which it is engaged in the first part, along a length that is greater than or equal to that of the first part, as can be seen in FIG. 71.

The second part can have a shoulder 245 which is situated in a plane of greatest width for the applicator member 8.

In the example in FIGS. 72 and 73, the first part 15 has spikes 219 on the side of the face 18, these spikes being visible in FIG. 72, and also around the perimeter of the first part 15, the second part 17 not having such spikes. The second part 17 may or may not comprise a flocked coating.

The first part 15 has two arms which converge in the direction of the distal end of the applicator member when the latter is viewed from the front, as in FIG. 72, forming a housing 40 between one another which is in the overall shape of a droplet, for example, as illustrated.

The spikes 219 which extend around the perimeter of the first part 15 can each have their longitudinal axis contained in a median plane M that intersects the applicator member substantially half-way through its thickness. The other spikes 219 can be oriented substantially perpendicularly to this plane M, as illustrated.

Of course, other examples of spike arrangements are possible without departing from the scope of the present invention.

The hinge can be realized as illustrated in FIG. 74, with two flexible strands 234 which are each attached to the parts 15 and 17 at a distance from their proximal end. The strands form a sort of frame in top view, in the moulding configuration.

The invention is not limited to the examples illustrated.

In particular the features of the various examples illustrated can be combined as parts of variants which are not illustrated.

For example, in a general manner, the two parts can be flocked, the flockings being different; one of the parts may comprise a relief of a certain type on one side and a different type of relief on the other side so as to have different effects on one side of the applicator and the other.

The expression "comprising a" is synonymous with "comprising at least one".

The invention claimed is:

1. Applicator member for applying a cosmetic product to human keratin materials, comprising an applicator head having two opposite faces, the applicator head comprising:

a first part having at least one housing, and a second part that is connected to the first part by a hinge and is at least partially and fixedly engaged in the housing of the first part, wherein the first and second parts are both accessible from each of said faces of the applicator head, the first and the second parts comprise cooperating reliefs that cooperate to maintain the second part fixedly engaged in the housing of the first part without external force and/or the applicator member comprises an end piece and the second part is maintained fixedly engaged in the housing of the first part by the introduction of the end piece into a recess in a stem.

2. Applicator member according to claim 1, wherein the second part contains the product to be applied.

3. Applicator member according to claim 1, wherein the hinge is a film hinge or comprises two flexible strands.

4. Applicator member according to claim 1, wherein the second part is connected to the first part by a hinge disposed on the applicator member away from the distal end of the applicator member.

5. Applicator member according to claim 1, wherein at least one of the first and the second part is at least partially flocked.

6. Applicator member according to claim 5, wherein the other of the first and the second part is not flocked.

7. Applicator member according to claim 5, wherein the other of the first and the second part is at least partially flocked, the flocking of the first part being different from the flocking of the second part.

8. Applicator member according to claim 1, wherein at least one of the first and second parts has protruding or recessed reliefs.

9. Applicator member according to claim 1, wherein the second part is engaged entirely in the housing of the first part.

10. Applicator member according to claim 1, wherein the second part protrudes from the first part when the applicator member is viewed from the side.

11. Applicator member according to claim 1, wherein the second part comprises a pattern or an inscription in the form of reliefs or printing.

12. Applicator member according to claim 1, wherein the second part takes up all of the housing of the first part.

13. Applicator member according to claim 1, wherein the second part takes up some of the housing of the first part, the first and the second part defining a space between one another for product to collect in.

14. Applicator member according to claim 1, wherein the second part comprises a fixing tab that is engaged in the housing of the first part.

15. Applicator member according to claim 14, wherein the first part comprises a fixing hook that is inserted into or under the through-opening, the fixing tab cooperating with the fixing hook in order to keep the second part folded over the first part.

16. Applicator member according to claim 15, wherein one of the fixing hook and the fixing tab is flush with the surface of one of said faces.

17. Applicator member according to claim 1, wherein the second part comprises a through-opening.

18. Applicator member according to claim 1, wherein the first part is made of a flexible material.

19. Applicator member according to claim 1, wherein the first and the second part form a single part moulded in thermoplastic material.

20. Applicator member according to claim 1, wherein the applicator head is attached to a mounting or gripping end piece.

21. Applicator member according to claim 20, wherein the end piece is formed from two half end pieces that are connected together by the hinge.

22. Applicator member according to claim 1, wherein the first and the second part are fixed together, in the use configuration, in a removable manner by snap-fastening or force-fitting.

23. Applicator member according to claim 1, wherein the first part bears a flocked coating and the second part spikes, or vice versa.

24. Device for applying a cosmetic product to human keratin materials, comprising:

a stem of longitudinal axis X, an applicator member according to claim 1, which is fixed to the end of the stem.

25. Device according to claim 24, the applicator member wherein the applicator head is attached to a mounting or gripping end piece, wherein the end piece is inserted into an open recess at the end of the stem.

26. Device according to claim 24, wherein the applicator member is for applying a product to the skin and/or lips.

27. Device according to claim 24, wherein the applicator member is for applying a product to the eyelashes and/or eyebrows.

28. Method for manufacturing the device according to claim 24, comprising the step of fixing the applicator member to a stem, the applicator head comprising:

a first part having at least one housing, and a second part that is connected to the first part by a hinge and is at least partially and fixedly engaged in the housing of the first part, wherein the first and second parts are both accessible from each of said faces of the applicator head.

29. Method for manufacturing the applicator member according to claim 1, comprising the steps of:

moulding a body of the applicator member in the open configuration, with a first part having at least one housing, and a second part that is connected to the first part by a hinge and is intended to be engaged in the housing after the second part has been folded over the first part, applying an adhesive to one of the first and the second part, applying flocking bristles to the adhesive, folding the second part over the first part so that the second part is at least partially engaged in the housing of the first part.

30. Method according to claim 29, wherein the body of the applicator member comprises two half end pieces that are attached at their distal ends to the first and the second part, respectively, and are connected together at their proximal ends by the hinge.

31. Applicator member for applying a cosmetic product to human keratin materials, comprising an applicator head having two opposite faces, the applicator head comprising:

a first part having at least one housing, and a second part that is connected to the first part by a hinge, is at least partially engaged in the housing of the first part, the second part comprising, on at least one of its faces, a cavity, different from spaces formed between adjacent bristles or teeth present on an applicator, that contains the product to be applied so as to allow application of the cosmetic product on first use without the need for a reservoir separate from the applicator member.

32. Applicator member according to claim 31, wherein the first and second parts are both accessible from each of said faces of the applicator head.

33. Applicator member according to claim 31, wherein the second part comprises, on at least one of said faces, a porous material.

* * * * *